US011505951B2

(12) United States Patent
MacKenzie

(10) Patent No.: US 11,505,951 B2
(45) Date of Patent: Nov. 22, 2022

(54) ATTACHMENT SYSTEM FOR DECKING AND SIDING

(71) Applicant: Duncan MacKenzie, Ashland, OR (US)

(72) Inventor: Duncan MacKenzie, Ashland, OR (US)

(73) Assignee: Duncan MacKenzie, Ashland, OR (US)

( * ) Notice: Subject to any disclaimer, the term of this patent is extended or adjusted under 35 U.S.C. 154(b) by 0 days.

(21) Appl. No.: 17/149,401

(22) Filed: Jan. 14, 2021

(65) Prior Publication Data

US 2021/0131121 A1 May 6, 2021

Related U.S. Application Data

(63) Continuation of application No. 16/554,315, filed on Aug. 28, 2019, now Pat. No. 10,895,080.

(51) Int. Cl.

| | |
|---|---|
| ***E04F 15/02*** | (2006.01) |
| ***E04B 1/00*** | (2006.01) |
| ***E04F 13/08*** | (2006.01) |

(52) U.S. Cl.

CPC ..... *E04F 15/02044* (2013.01); *E04B 1/003* (2013.01); *E04F 13/0835* (2013.01); *E04F 15/02183* (2013.01); *E04F 2015/02122* (2013.01)

(58) Field of Classification Search

CPC ..... E04F 15/02044; E04F 13/0835; E04F 2015/02094; E04F 15/02183; E04F 2015/02122; E04B 1/40; E04B 1/003

See application file for complete search history.

(56) References Cited

U.S. PATENT DOCUMENTS

| | | | |
|---|---|---|---|
| 2,659,323 | A | 11/1953 | Alvarez, Jr. |
| 3,015,193 | A | 1/1962 | Amoruso |
| 3,174,256 | A | 3/1965 | Lockwood |
| 3,237,360 | A | 3/1966 | Mills |
| 3,261,136 | A | 7/1966 | Abner et al. |
| 3,568,391 | A | 3/1971 | Conway |
| 4,506,486 | A | 3/1985 | Culpepper, Jr. et al. |
| 4,925,141 | A | 5/1990 | Classen |
| 5,497,593 | A | 3/1996 | Riesberg |
| 5,501,050 | A | 3/1996 | Ruel |
| 5,997,209 | A | 12/1999 | Sachs |
| 6,170,214 | B1 | 1/2001 | Treister et al. |

(Continued)

FOREIGN PATENT DOCUMENTS

| | | |
|---|---|---|
| JP | 60158814 A | 6/1994 |

*Primary Examiner* — Babajide A Demuren

(74) *Attorney, Agent, or Firm* — Chernoff, Vilhauer, McClung & Stenzel, LLP

(57) ABSTRACT

A deck system including hold-down devices for attaching deck boards to deck support structures and a siding system including attachment devices for mounting siding boards to wall structures. Hold-down devices are attached to deck support structures by horizontally-extending fasteners and attach the deck boards to the deck support structures without fasteners providing paths for water to pass through the deck boards into the support structures. Deck board engagement members of the hold-down device extend into slots in deck boards. Siding board attachment devices are mounted on upright surfaces of wall structures using horizontally extending fasteners. Siding boards are mounted with a standoff distance providing ventilation space behind and between siding boards.

7 Claims, 32 Drawing Sheets

(56) References Cited

U.S. PATENT DOCUMENTS

| | | | |
|---|---|---|---|
| 6,195,952 | B1 | 3/2001 | Culpepper et al. |
| D450,568 | S | 11/2001 | Sachs |
| 6,315,489 | B1 | 11/2001 | Watanabe |
| 6,349,507 | B1 | 2/2002 | Muellerleile |
| 6,598,362 | B2 | 7/2003 | Hikai |
| 6,615,560 | B2 | 9/2003 | Hiroshi |
| 6,637,170 | B2 | 10/2003 | Hiroshi |
| 6,786,804 | B2 | 9/2004 | Watanabe |
| 6,830,405 | B2 | 12/2004 | Watanabe |
| D530,833 | S | 10/2006 | Robertson et al. |
| D573,454 | S | 7/2008 | Egerle, III |
| 7,665,260 | B2 | 2/2010 | Hikai |
| D617,011 | S | 6/2010 | Guffey |
| 7,849,651 | B2 | 12/2010 | Fujito et al. |
| 9,422,728 | B2 | 8/2016 | Gamble et al. |
| 9,976,312 | B2 | 5/2018 | Boschian |
| D839,723 | S | 2/2019 | Bowker |
| 2002/0023398 | A1 | 2/2002 | Hiroshi |
| 2002/0046536 | A1 | 4/2002 | Hotta |
| 2003/0154662 | A1 | 8/2003 | Bruchu et al. |
| 2004/0111993 | A1 | 6/2004 | Hollman |
| 2006/0265988 | A1 | 11/2006 | Fujito et al. |
| 2008/0216430 | A1 | 9/2008 | Gleeson et al. |
| 2009/0217495 | A1 | 9/2009 | Tipps et al. |
| 2009/0249721 | A1 | 10/2009 | Cullen |
| 2012/0117901 | A1 | 5/2012 | Loyd |
| 2013/0014465 | A1* | 1/2013 | Kilgore ..... E04F 15/02183 52/650.3 |
| 2013/0025230 | A1 | 1/2013 | Turner |
| 2014/0366334 | A1* | 12/2014 | Gamble ..... F16B 5/02 24/305 |
| 2015/0275951 | A1 | 10/2015 | Shadwell et al. |
| 2019/0284796 | A1 | 9/2019 | Bowker |
| 2021/0131121 | A1* | 5/2021 | MacKenzie ..... E04F 15/02183 |
| 2021/0164235 | A1* | 6/2021 | Schneider ..... E04F 13/0862 |

* cited by examiner

ATTACHMENT SYSTEM FOR DECKING AND SIDING

CROSS REFERENCE TO RELATED APPLICATION

This application is a continuation of U.S. patent application Ser. No. 16/554,315 filed Aug. 28, 2019. The complete disclosure of the above application is hereby incorporated by reference for all purposes.

BACKGROUND OF THE INVENTION

The present invention relates to attachment of deck boards and siding boards to supporting structures, and in particular to hold-down devices for attaching deck boards to joists and the like in residential or commercial decking, and attachment devices for mounting siding boards on exterior walls.

Attachment of deck boards to deck supporting structures traditionally has involved the use of nails or screws extending downward through deck boards into the horizontal upper surfaces of joists and beams of deck support structures. Those nails and screws have provided pathways for moisture to proceed into the joists or beams, leading to decay and eventually resulting in weakening or collapse of the deck supporting structures.

While deck boards and siding boards have traditionally been of solid wood, other materials are also used, such as decking boards of composite materials incorporating stiffening fibers in plastic base material, or siding boards of plastic composites or hard concrete-like materials. It is possible to mount such deck boards or siding boards in the same manner as has been used for years with wooden boards, but improvement is desired.

It is desirable to attach siding boards to exterior wall supporting structures, such as sheathing covered with moisture barrier materials, so as to provide open spacing for drainage and ventilation between the siding boards and the exterior surfaces of the support structures. This has been accomplished previously using various types of standoff fastening devices, usually requiring siding boards to overlap lower siding boards. Mounting siding boards so that they overlap one another results in some materials being used to form the overlapping portions of siding boards. It is desired to be able to install siding easily and economically and without the need for siding boards to overlap. It may also be desired to mount siding boards similarly as interior design features.

What is needed, then, are improved systems for mounting deck boards on a deck-supporting framework and for mounting siding boards on exterior or interior walls of buildings. Such systems should desirably include mounting devices that can be manufactured economically and installed easily.

SUMMARY OF THE INVENTION

Disclosed herein are several variations of attachment systems and devices for use in mounting deck boards and siding boards securely to supporting structures, as defined in the following claims. Such systems avoid defining paths for easy movement of water such as rainfall through the deck boards and siding boards and into supporting wooden beams, joists, and exterior wall structures of buildings.

Attachment devices of a first type include members that can be fastened to vertical side surfaces of members of deck support structures and include portions that extend upward between deck boards supported on the horizontal top surfaces of joint or equivalent members of deck support structures to establish spacing between the deck boards. The attachment devices also include portions that are extend horizontally toward lateral edge faces of deck boards so as to engage grooves defined in the lateral edge faces, or to pierce the lateral edge faces, and thereby hold the deck boards in position atop the joists, beams, and other members of a deck support structure.

Attachment devices of another type include engagement members extending from a base portion and adapted to mate with grooves defined in the bottom surfaces of deck boards or with grooves defined in vertical surfaces of siding boards, so as to attach the deck boards securely to deck support structures and to attach siding boards securely to interior or exterior building wall structures.

Also disclosed herein are tools adapted for use in effective installation of the attachment devices so as to securely fasten deck boards and siding boards in place.

The foregoing and other objectives and features of the invention will be more readily understood upon consideration of the following detailed description of the invention taken in conjunction with the accompanying drawings.

DETAILED DESCRIPTION OF PREFERRED EMBODIMENTS

Figures 1, 2, 3:
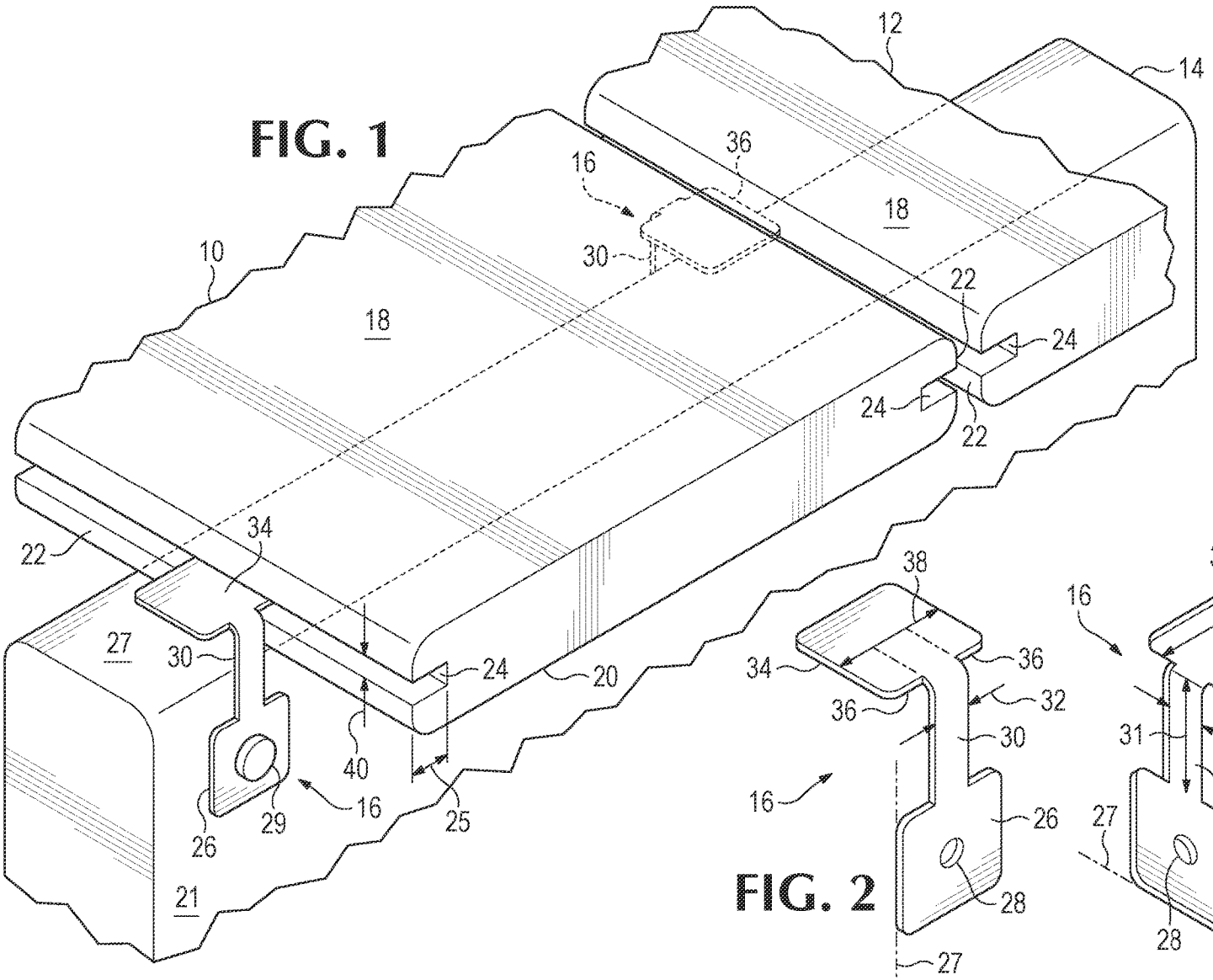
FIG. 1 is an isometric view of a portion of a deck frame joist with portions of deck boards shown resting atop the joist and held in place by hold-down devices of sheet metal construction fastened to the joist.
FIG. 2 is an isometric view of one of the deck board hold-down devices shown in FIG. 1.
FIG. 3 is an isometric view of the deck board hold-down device shown in FIG. 2, taken from an opposite direction.

Referring now to the drawings that form a part of the disclosure herein, deck boards can be attached to supporting structures using attachment devices that do not require fasteners to puncture deck boards in a way that can provide a path downward from an upper surface of a deck board into an upper surface of a supporting beam or joist.

As shown in FIGS. 1-3, a pair of deck boards 10 and 12 are supported on a joist 14, across which they extend perpendicularly and to which they are attached by hold-down devices 16. Each of the deck boards 10 and 12 has a top face 18, a bottom face 20, and a pair of opposite lateral, or edge, faces 22. A groove 24 is defined in each of the lateral faces 22, extending longitudinally along the lateral, or edge, faces 22 of the deck boards 10 and 12. The grooves 24 may be similar to the grooves that are conventionally formed in a margin of a tongue-and-groove board, with a depth 25, for example, of about 1 cm.

Each hold-down device 16 may be of suitably thick and strong sheet metal and may include a generally planar attachment member 26 having a mounting side intended to contact a surface on which the hold-down device is mounted, and defining a fastening plane 27 and a through hole 28 of an appropriate size for receiving a fastener 29 such as a nail or screw. While such a fastener 29 necessarily forms a hole extending into the side 21 of the joist 14, such a hole extends horizontally, rather than leading downward and encouraging movement of rainwater into the joist 14 or other structural member of a wooden frame supporting the deck boards.

A spacer neck 30 connected with the attachment member 16 has a length 31 that extends away from the attachment member 16, ordinarily in the same plane as the attachment member 26, and has a width 32 that may be equal to a desired spacing between the deck boards 10 and 12 when installed, for example, 6.25 mm. At the end of the spacer neck 30 opposite from the attachment member 26 is a deck board engagement member 34 or head, oriented in a plane perpendicular to that of the attachment member 26. The engagement member 34 may include a pair of oppositely extending deck board engaging margin portions 36 that may be referred to as wings. The deck board engagement member 34 may have a width 38 of about 2.5 cm so that the margin portions 36 extend into the grooves 24 nearly to the full depth 25 of the grooves 24 when the lateral edge faces 22 of the deck boards 10 and 12 abut against the spacer neck 30 so that the spacer neck establishes the spacing between adjacent ones of the deck boards 10 and 12, as seen in FIG. 1. The spacer neck 30 may be bent at a right angle, a small distance from the deck board engagement member 34, so that the deck board engagement member 34 is located a small distance away from the vertical side surface 21 of the joist 14. The deck board engagement member 34 may have a length 37 of about 3 cm, for example, so as to extend over more than half the width of a joist 14 that is of nominal 2×6 lumber. As a matter of choice, successive deck board hold-down devices 16 may be mounted on opposite sides of a deck support joist 14, as shown in FIG. 1.

When the intended location of a first deck board 18 is determined the deck board may be laid atop a supporting member such as the joist 14, and the hold-down device 16 may be positioned with its attachment member 26 against a vertical side 21 of the joist 14. With the wing 16 located in the groove 24 to hold the deck board 18 down in contact with the upper surface 27 of the joist 14 the appropriate fastener 29 is driven into the joist. With the first deck board 18 held down against the top 27 of the joist 14 and the lateral edge face of the deck board 18 in contact against the spacer neck of the first hold-down device 16, a second hold-down device 16 may then be placed with the appropriate wing or margin part 36 located in the groove 24 on the opposite lateral face 22 of the deck board 18. With the attachment member of the second hold-down device positioned against a vertical side 21 of the joist, a fastener 29 may be driven to attach the second hold-down device 16 to the joist 14. The same steps may be taken with respect to each deck board at additional positions, such as at each supporting joist 14 or beam along the length of each deck board 10 or 12, so as to fasten the deck boards securely in place. With each subsequent deck board 12 positioned snugly in contact with the spacer neck portion 30 of a hold-down device 16 securing a previously installed deck board to the supporting joists or beams, the hold-down devices 16 can be utilized to establish and maintain a desired spacing between all the deck boards of a deck, once the first deck board has been properly positioned and secured.

Figure 4A:
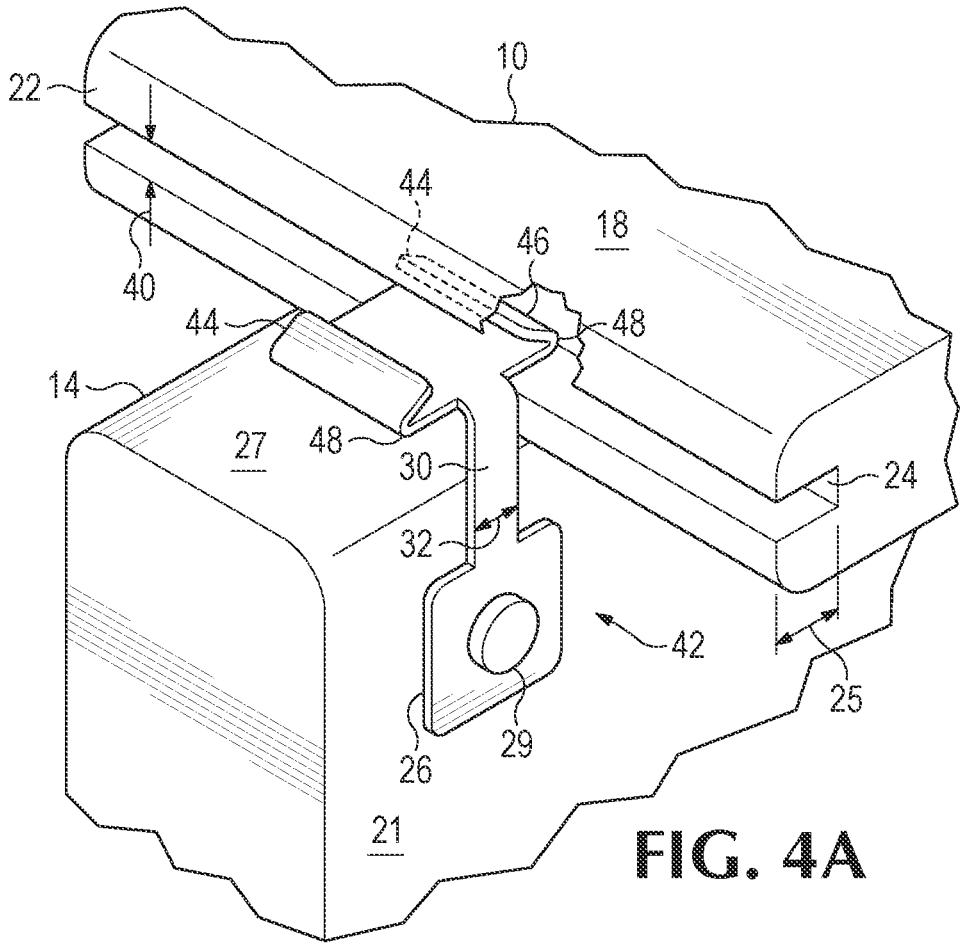
FIG. 4A is an isometric, partially cutaway, view of a portion of a deck frame joist with a deck board resting atop the joist and held in place by a hold-down device of sheet metal including a deck board-engaging wing portion.
Figure 4B:
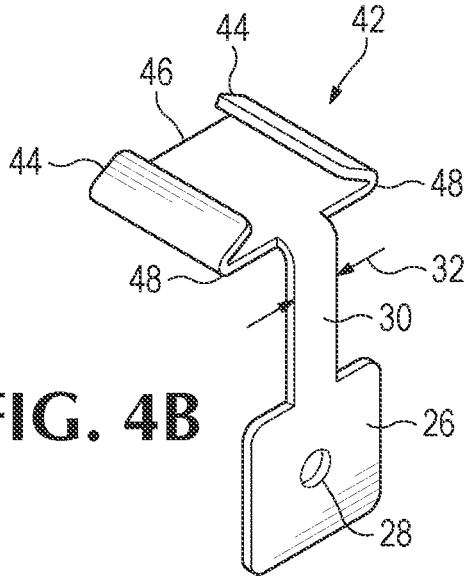
FIG. 4B is an isometric view of the deck board hold-down device shown in FIG. 4A.
Figure 4C:
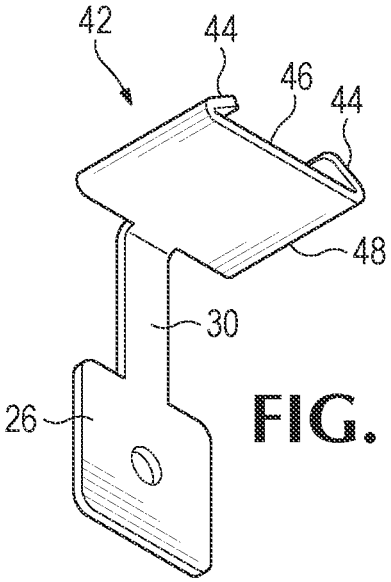
FIG. 4C is an isometric view of the deck board hold-down device shown in FIGS. 4A and 4B.

As the grooves 24 provided in lateral edge faces 22 of such deck boards 10 and 12 may have widths 40 that are greater than the thickness of the sheet metal of which the hold-down devices are made, hold-down devices 42 such as those shown in FIGS. 4A-4C may be utilized to fit more precisely in the grooves 24 provided in deck 10 or 12 boards being mounted. The hold-down devices shown in FIGS. 4A-4C differ from those shown in FIGS. 1-3 in that each wing 44 of the engagement member portion 46 of a hold-down device 42 includes an sharp bend 48 through an angle of, for example, 145° forming a groove-engaging wedge-like wing portion 44 subtending an angle of about 35° and having an effective height or thickness that may equal or very slightly exceed the width 40 of each groove 24, so that each wing portion 44 fits tightly within a groove of such a deck board, as may be seen best in FIG. 4.

Figure 5A:
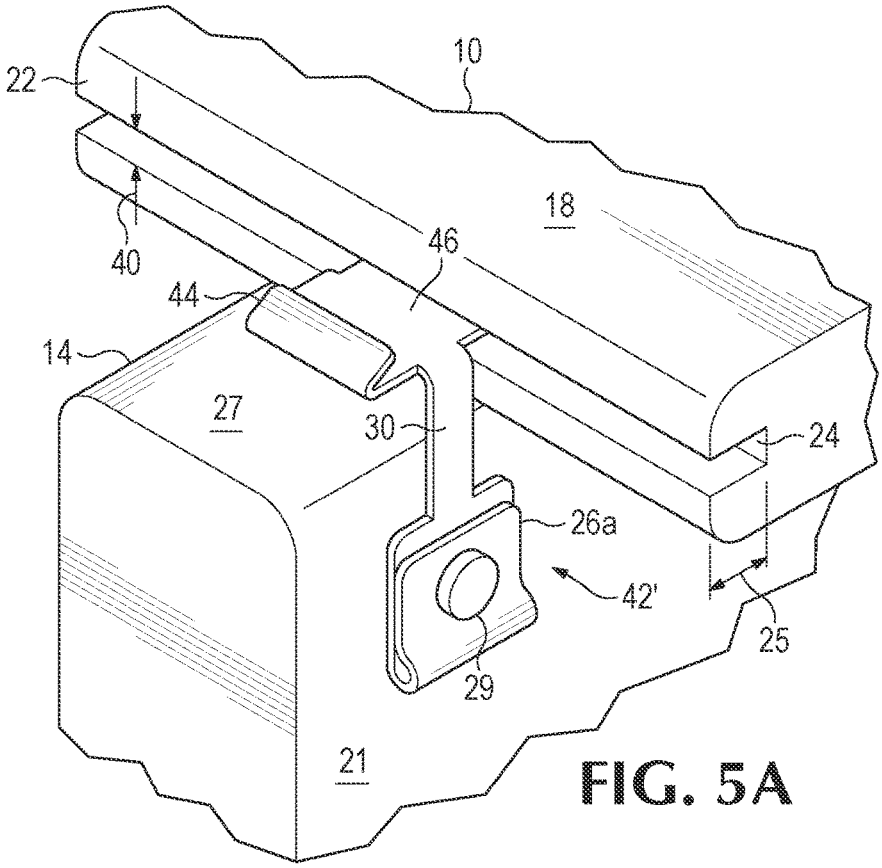
FIG. 5A is an isometric view of a portion of a deck frame joist with a deck board resting atop the joist and held in place by a hold-down device of sheet metal that is a variation of the hold-down device shown in FIGS. 4A-4C, in which a fastener is held ready for use.
Figure 5B:
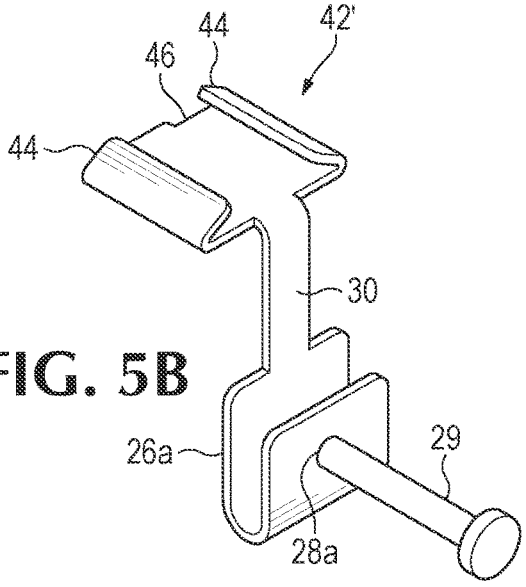
FIG. 5B is an isometric view of the deck board hold-down device shown in FIG. 5A.
Figure 5C:
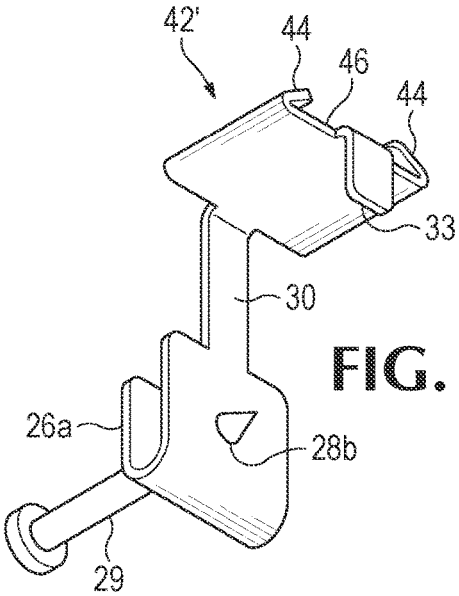
FIG. 5C is an isometric view of the deck board hold—the down device shown in FIG. 5A and FIG. 5B, taken from an opposite direction.

A hold-down device 42' which is a variation of the hold down device 42 is shown in FIGS. 5A, 5B, and 5C and has an attachment member 26*a* in which two similar parts extend parallel alongside each other connected by a bend in the sheet metal to form a narrow U configuration. Holes 28*a* and 28*b* are aligned with each other so that a nail 29 or other fastener can be inserted through both of those holes 28*a* and 28*b* and will remain in place during handling and eventual installation of the hold down device 42. This avoids the step of having to insert the fastener 29 into the hole 28 when installing the hold-down device 42' as is necessary for installation of the hold-down device 42 shown in FIGS. 4A-4C. A short spacer 33 may extend from the side of the engagement member 46 opposite the spacer neck 30 as a further gauge for separation of deck boards engaged by the hold-down device 42'.

Figure 6A:
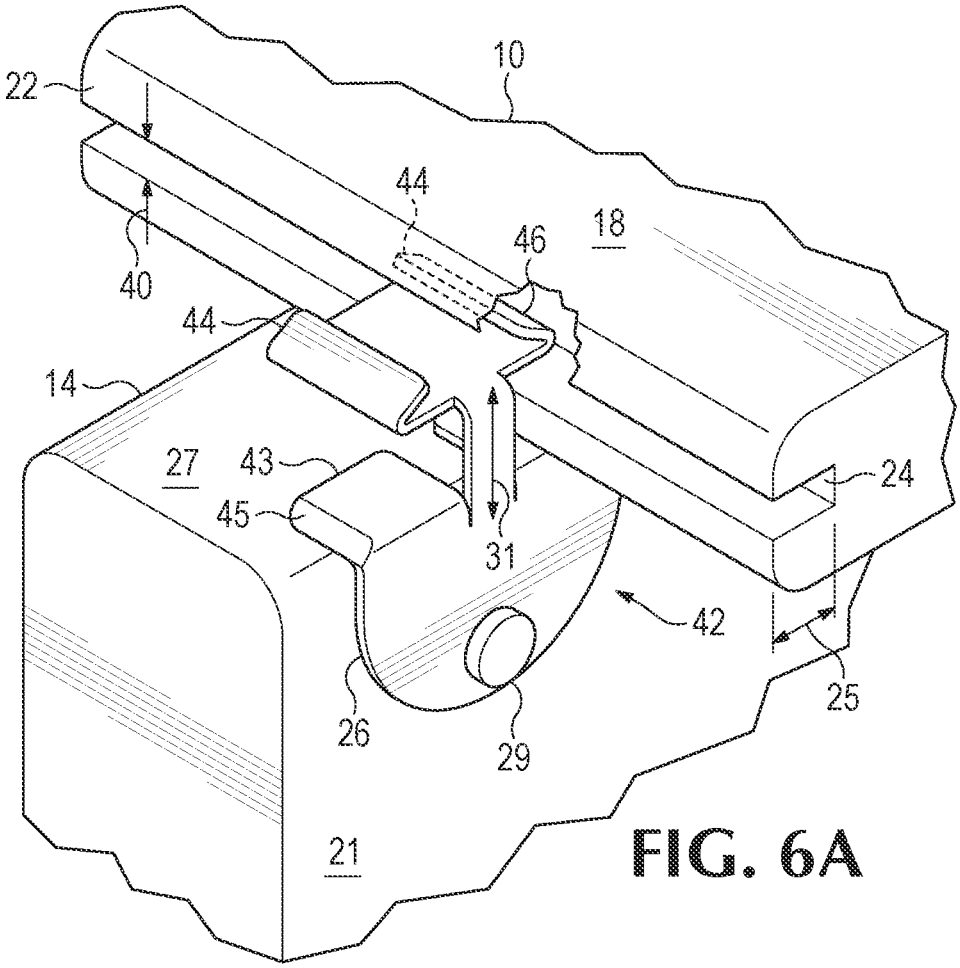
FIG. 6A is an isometric, partially cutaway, view of a portion of a deck frame joist with a deck board resting atop the joist and held in place by a hold-down device of sheet metal of somewhat different construction from that of the devices shown in FIGS. 4A-4C and 5A-5C and including a deck board-engaging wing portion.
Figure 6B:
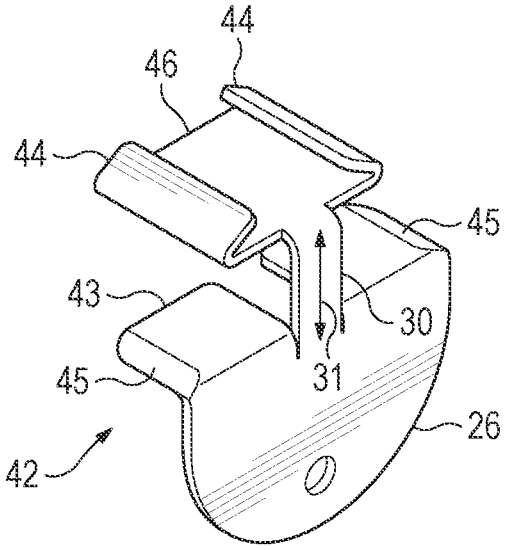
FIG. 6B is an isometric view of the deck board hold-down device shown in FIG. 6A.
Figure 6C:
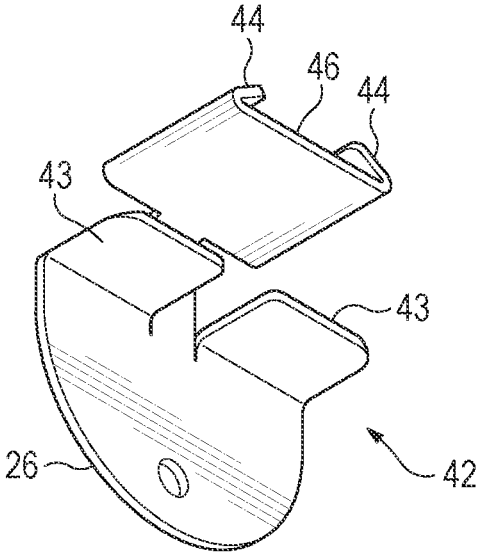
FIG. 6C is an isometric view of the deck board hold-down device shown in FIG. 6B, taken from an opposite direction.

A hold-down device 42" which is another variation of the hold-down device 42 is shown in FIGS. 6A, 6B, and 6C, and includes a generally semicircular attachment member 26" from which a pair of height-setting arms 43, each having a chamfered edge portion 45, extend perpendicularly away from the attachment member 26 so as to rest atop the top surface 27 of the joist 14. The spacer neck 30 therefore has a length 31 corresponding to the height of the groove 24 in a deck board 10 or 12 resting atop the arm 43. With the deck board 10 or 12 resting on the arm 43 an amount of ventilation is possible between the deck board and the top surface 27 of the joist 14.

Figure 7:
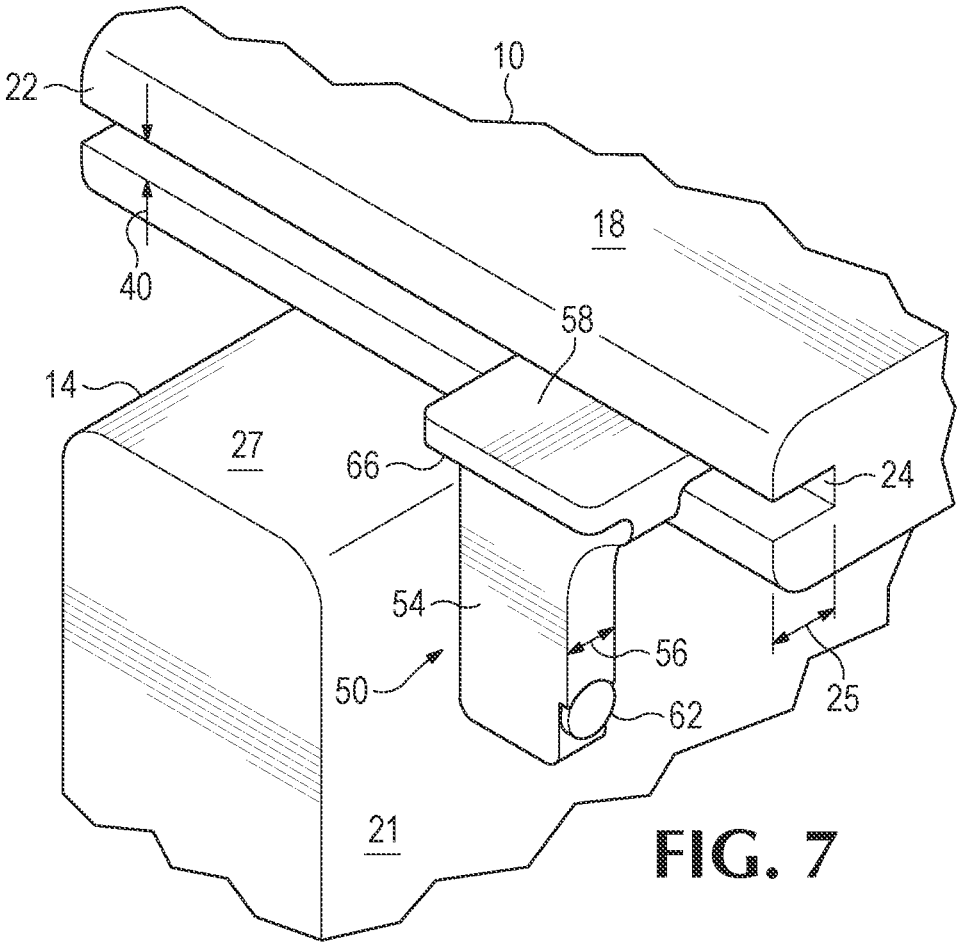
FIG. 7 is an isometric view of a portion of a deck frame joist with a deck board resting atop the joist and held in place by a hold-down device of plastics that is fastened to the joist.
Figure 8:
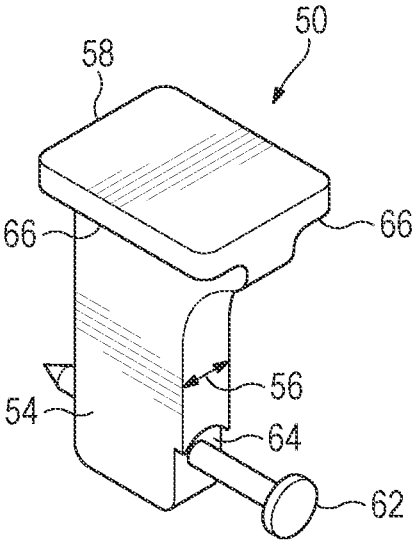
FIG. 8 is an isometric view of the hold-down device shown in FIG. 7.
Figure 9:
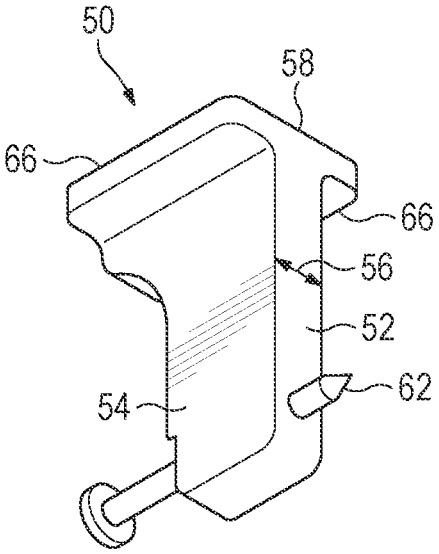
FIG. 9 is an isometric view of the hold-down device shown in FIG. 8, taken from an opposite direction.

As may be seen in FIGS. 7-9, a functionally equivalent hold-down device 50 may be molded of a suitable material, such as a plastics based composite material, for example, a fiber-reinforced PVC, polyethylene, polypropylene, or ARAMID material. The hold-down device 50 includes a flat face 52 defining a fastening plane and intended to be mounted snugly in contact with a vertical side surface 21 of a joist 14. A spacer neck portion 54 may have a width 56, in a direction transverse to the length of a deck board 10 to be secured by the hold-down device 50, equal to the desired spacing between adjacent deck boards. A deck board engagement member 58 extends perpendicularly away from the face 52 so as to be oriented horizontally, parallel with the top surface 27 of a joist 14 to which the hold-down device is to be attached.

A bore is provided in the spacer neck 54 to receive a fastener 62 such as a nail or screw. A recess 64 may be molded in the lower end of the spacer neck 54 so that a head of a fastener 62 will be flush, and water draining down along the hold-down device 50 will be carried down over the outer face of the head of a fastener 62 such as a nail, rather than being led inward along the shank of the fastener toward the joist 14.

The engagement member 58 may have wing portions 66 wide enough to extend securely into the groove 24 is a lateral face 22 of a deck board. Each wing portion 66 may have a thickness about equal to the width 40 of the groove 24 formed in the lateral or edge face 22 of a deck board 10 intended to be secured to a joist 14 or equivalent member of a deck supporting structure.

As may be seen in FIG. 7, the engagement member 58, rather than extending above the top face 27 of the joist 14, extends away from the joist 14 along the length of the deck board 10 attached by the hold-down device 50. It will be understood that the engagement member 58 could be designed to extend above the top surface 27 of the joist, but the design shown herein permits a larger amount of material to be used in the connection of the engagement member 58 to the spacer neck 54 to extend below the top face 27 of the joist 14, potentially making the connection somewhat stronger.

Figure 10:
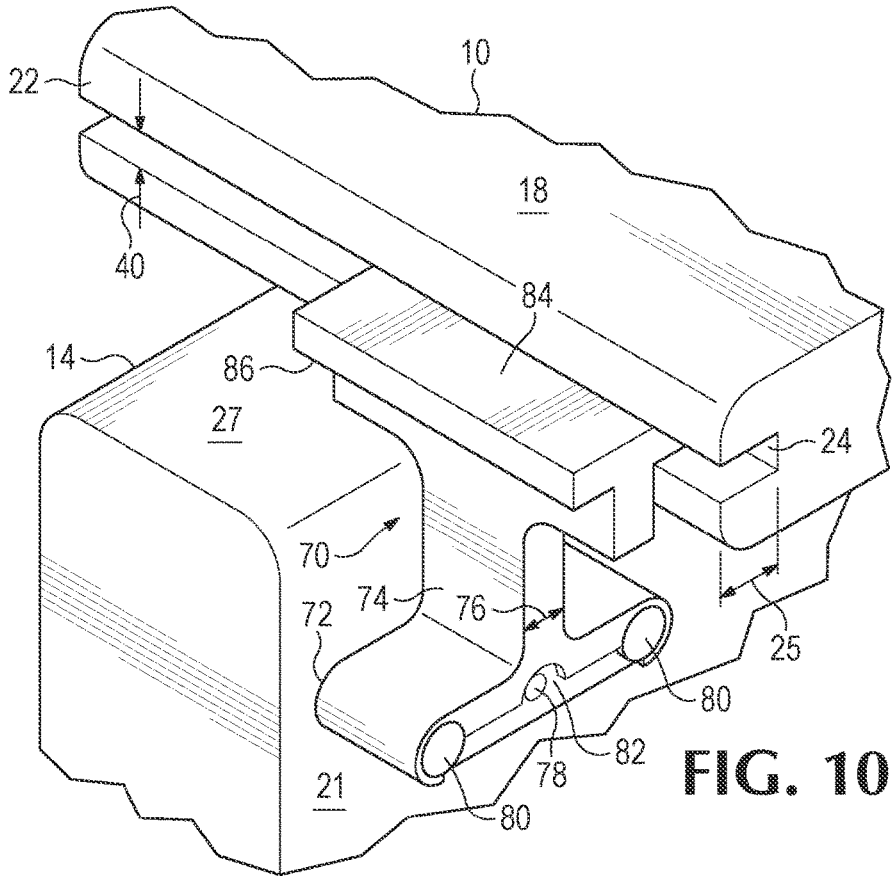
FIG. 10 is an isometric view of a portion of a deck frame joist with a deck board resting atop the joist and held in place by a different hold-down device of a plastic or composite material that is fastened to the joist.
Figure 11:
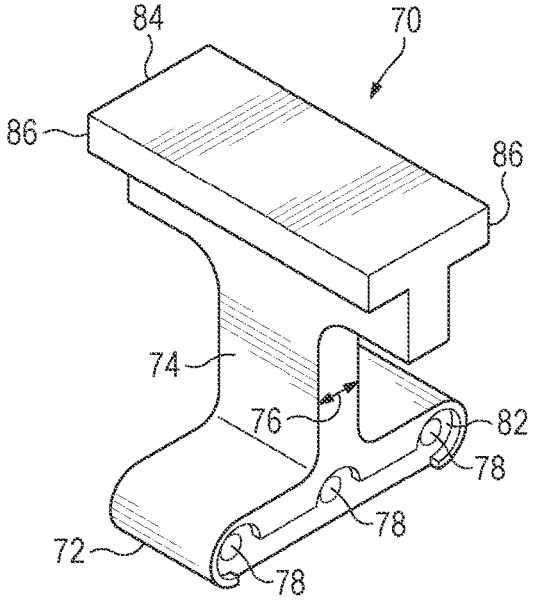
FIG. 11 is an isometric view of the hold-down device shown in FIG. 10.
Figure 12:
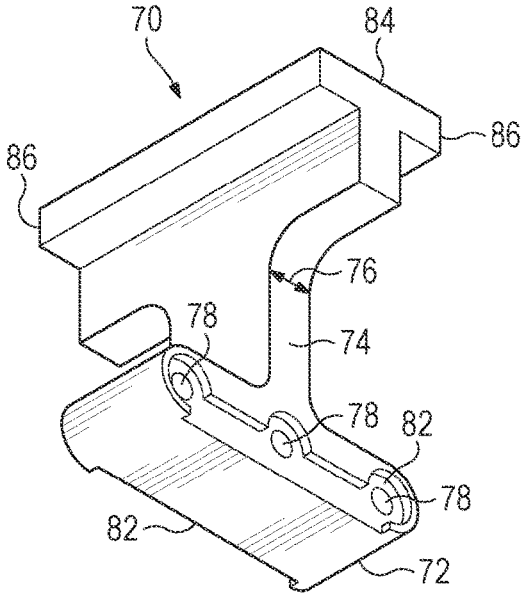
FIG. 12 is an isometric view of the hold-down device shown in FIG. 10, taken from an opposite direction.

Another somewhat different hold-down device 70 is shown in FIGS. 10-12. The hold-down device 70 is, like the hold-down device 50 described above, of a type that can be of molded material such as plastics composite material. As should be clear from the drawings the hold-down device 70 may be larger than the hold-down device 50 and thus may be advantageous for use in constructing decks intended to be subjected to heavier traffic. An attachment member 72 extends laterally in both directions away from a lower end of a spacer neck 74 whose width 76 may be designed to be a gauge to set a desired amount of spacing between adjacent deck boards 10, 12 held in place by the hold-down device 70. The attachment member 72 includes bores 78 designed to receive fasteners 80 in any of three possible positions, providing options for a person installing the hold-down device 70 where the presence of adjacent deck support structure or another object may interfere with installing a fastener 80 in any particular one of the three bores 78. As with the hold-down device 50 a recess 82 is provided at each bore 78 to receive the head of a fastener 80 and thus tend to divert draining water away from a potential pathway along the fastener 80 into the joist 14 or equivalent support member of the deck support structure to which the hold-down device 70 is attached.

The hold-down device 70 includes a deck board engagement member 84 that extends over a greater distance along the length of deck boards 10, etc., being secured to a deck support structure than does the engagement member 58 of the hold-down device 50 described above. In extending further, the engagement member 84 extends above a portion of the joist 14 or other support member to which it is fastened, as well as extending away from the joist 14, as may be seen best in FIG. 10. Margin portions 86, or wings, extend along each side of the engagement member 84 and can extend into the groove 24 of a deck board 10 or 12.

Figure 13A:
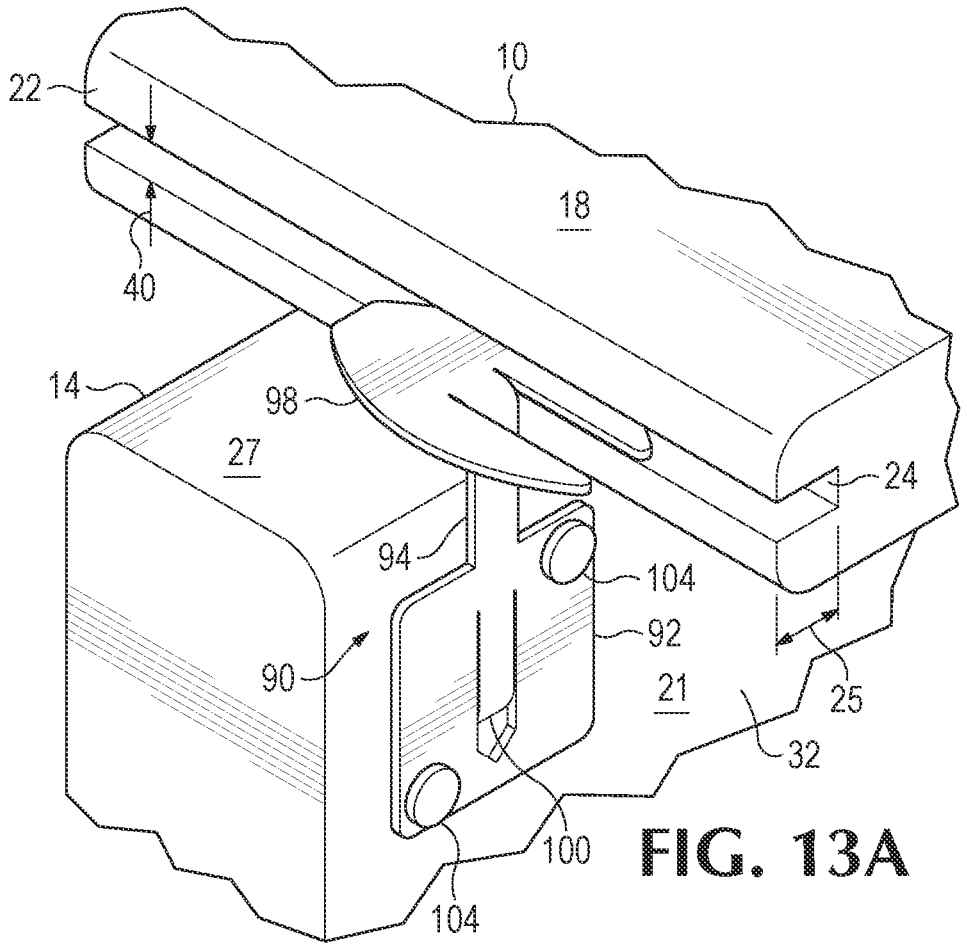
FIG. 13A is an isometric view of a portion of a deck frame joist with a deck board resting atop the joist and held in place by a sheet metal hold-down device that is fastened to the joist.
Figure 13B:
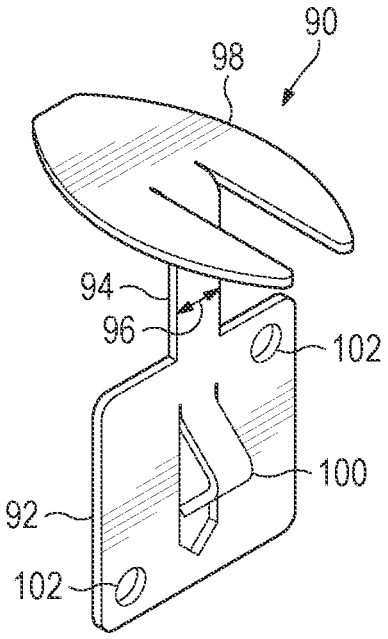
FIG. 13B is an isometric view of the hold-down device shown in FIG. 13A.
Figure 13C:
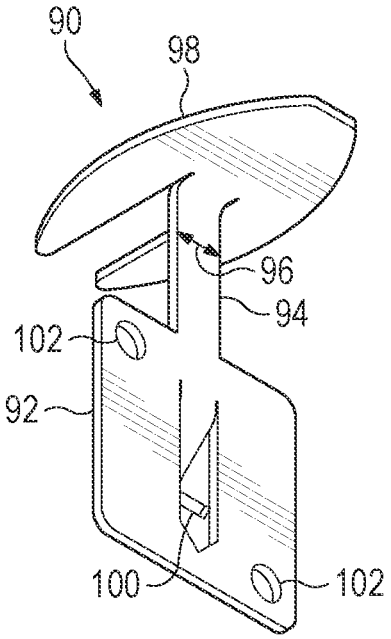
FIG. 13C is an isometric view of the hold-down device shown in FIG. 13A, taken from an opposite direction.

Referring next to FIGS. 13A, 13B, and 13C, a hold-down device 90 that may be of sheet-metal construction includes a planar attachment member 92 that may be generally rectangular and a spacer neck 94 extending upwardly away from the attachment member with a width 96 to define a spacing between deck boards 10. A deck board engagement member 98 may have the shape and size of a conventional "biscuit" fastener commonly used in connecting adjacent edges of boards to each other. As shown in FIG. 13A, the biscuit-shaped engagement member 98 may be used to engage a groove 24 defined along a lateral or edge face 22 of a deck board 10. Alternatively, a biscuit receptacle may be cut into the lateral, face 22 of a deck, board 10 during construction of a deck in which the hold-down device 90 is being used to secure deck boards 10, etc., to a supporting structure including joists 14, etc.

The attachment member 92 may be provided with an easy strike fastening tab 100 to be used for initially securing the hold-down device 90 to a vertical face 32 of a joist 14, and a pair of holes 102 are also provided in the attachment member 92 to receive conventional fasteners 104 such as screws or nails.

Figure 14:
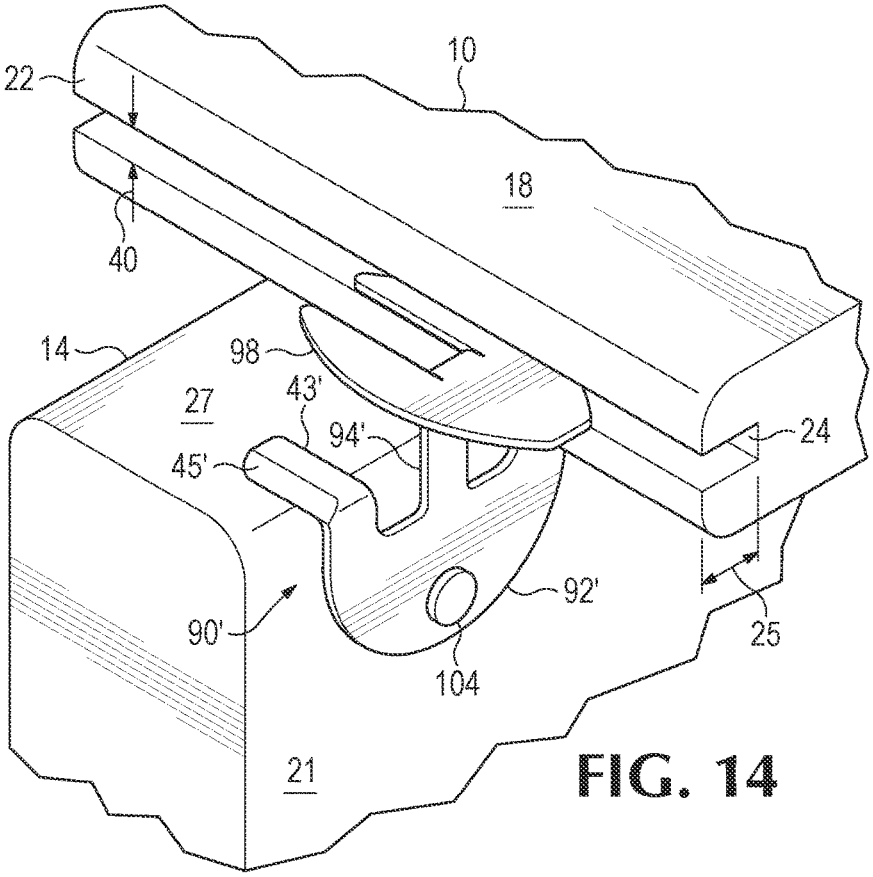
FIG. 14 is an isometric view of a portion of a deck frame joist with a deck board resting atop the joist and held in place by a sheet metal hold-down device that is fastened to the joist.
Figure 15A:
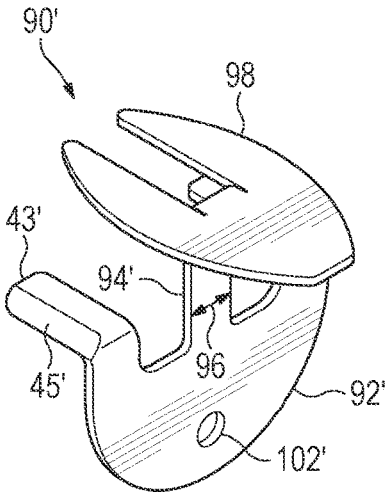
FIG. 15A is an isometric view of the hold-down device shown in FIG. 14.
Figure 15B:
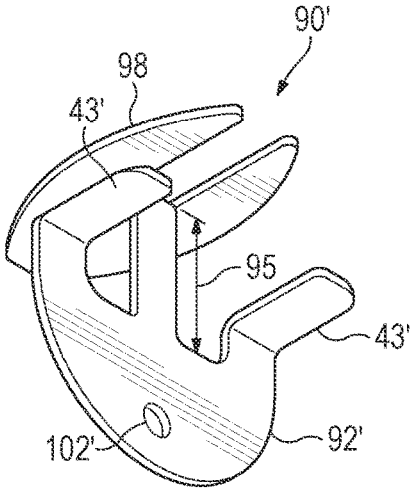
FIG. 15B is an isometric view of the hold-down device shown in FIG. 15A, taken from an opposite direction.

A slightly different hold-down device 90' of sheet metal construction is shown in FIGS. 14, 15A, and 15B. It includes an attachment member 92' that may be approximately semi-circular, resembling a rocker. A pair of height-setting arms 43' including chamfered surfaces 45' extend perpendicularly from the attachment member 92' so as to rest atop the horizontal top surface 27 of the joist 14 to which the hold-down device 90' may be attached by a suitable fastener 104 extending through a hole 102' defined in the attachment member 92'. As in the hold-down device 42 shown in FIGS. 6A, 6B, and 6C, there is a spacer neck 94' extending from the attachment member 92' having a width 96 that can be used to define the spacing between adjacent deck boards 10 being held down by the hold-down device 90'. The spacer neck 94' has a length 95 appropriate to place the attached biscuit-shaped engagement member 98 at the correct height to engage a groove 24 defined in a deck board 10, when the deck board 10 is resting atop one of the height-setting arms 43'.

Figure 16:
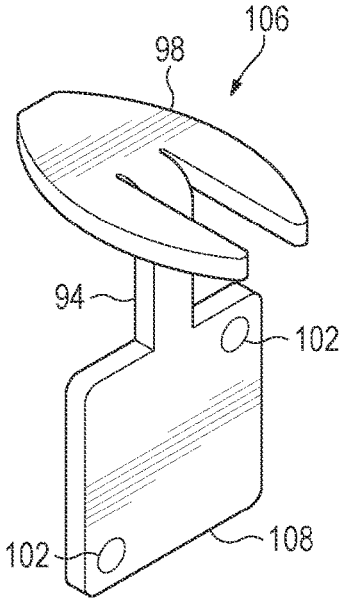
FIG. 16 is an isometric view of a hold-down device similar to that shown in FIGS. 13, 14, and 15, but that may be manufactured of a plastics or composite material.

The hold-down device 106 shown in FIG. 16 is similar to the hold-down device 90 shown in FIGS. 13A, 13B, and 13C except for the lack of the easy strike tab 100 in its attachment member 108, but may be of a substantially thicker sheet metal, or may be of molded plastic or composite construction.

Figure 17:
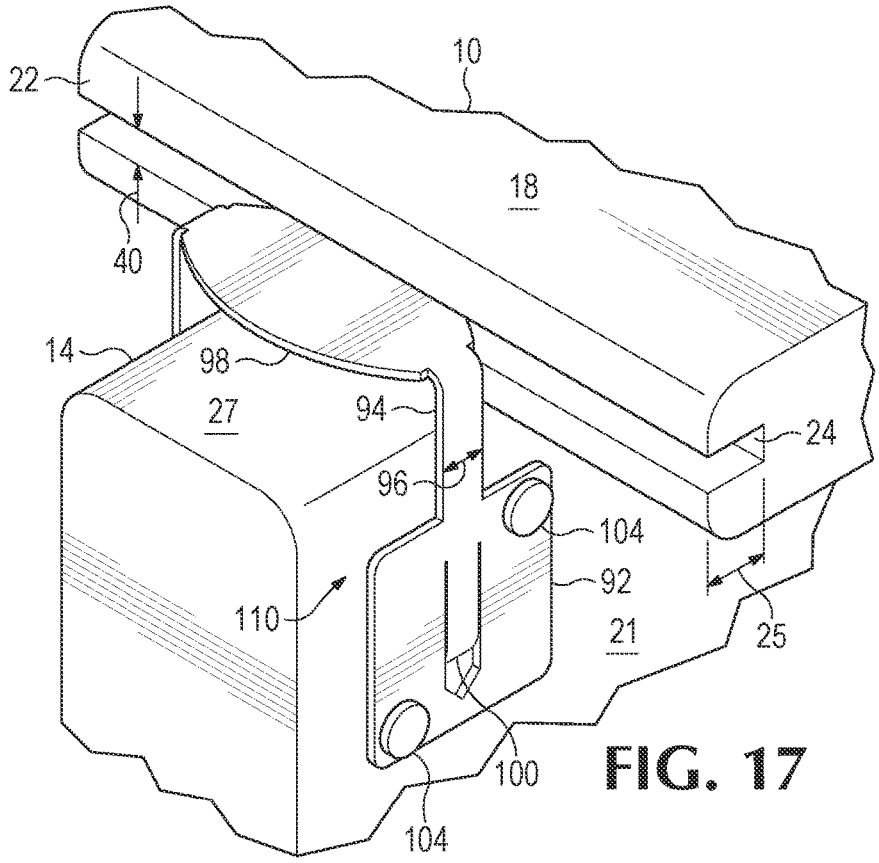
FIG. 17 is an isometric view of a portion of a deck frame joist with a deck board resting atop the joist and held in place by a sheet metal hold-down device that is fastened to both sides of the joist.
Figure 18:
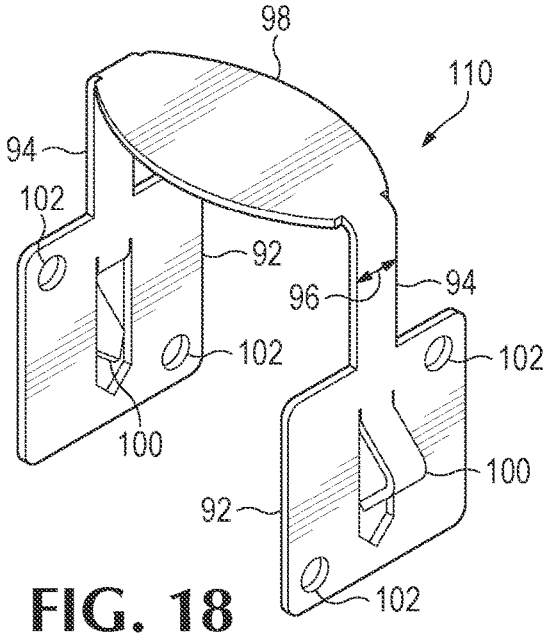
FIG. 18 is an isometric view of the hold-down device shown in FIG. 17.

As shown in FIGS. 17 and 18, in the hold-down device 110 the biscuit-shaped engagement member 98 may be attached to and extend between a pair of spacer necks 94 each extending upward from a respective attachment member 92 to one of the opposite ends of the engagement member 98. The spacer necks 94 may have equal widths 96 and may be used to establish the desired spacing between adjacent deck boards 10, etc., to be attached to a joist 14 of a deck support structure using the hold-down device 110. The spacer necks 94 may be parallel with each other and perpendicular to the engagement member 92, spaced apart from each other by slightly more than the width 39 of the joist 14 or other member of the deck support structure on which the hold-down device 110 is to be used. As a result, one of the attachment members 92 can be located on each side of a joist 14, as shown in FIG. 17, with the biscuit-shaped engagement member 98 spaced upwardly apart from the top surface 27 of the joist 14 by the appropriate distance to engage the groove 24 defined in a deck board 10. In installing the hold-down device 110, then, with a deck board 10 in the required position, the laterally extending portion of the engagement member may be placed in position to retain the deck board, and the easy strike tabs 100 may be engaged in both sides of the joist 14 to keep the hold-down device 110 in place while fasteners 104 such as nails or screws are installed for a permanent attachment. It will be appreciated that the placement of the holes 102 for receiving fasteners 104 in the attachment members 92 assures that fasteners 104 installed on one side of the joist 14 will not interfere with fasteners 104 installed from the other side of the joist 14 in the process of mounting the hold-down device 110.

Figure 19:
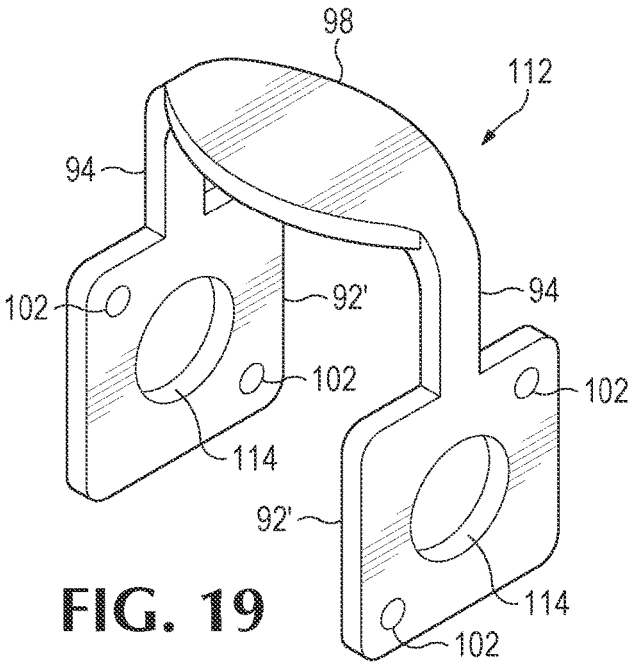
FIG. 19 is an isometric view of a hold-down device similar to the one shown in FIGS. 17 and 18, but that may be constructed of a composite material, or another diecast material.
Figure 20:
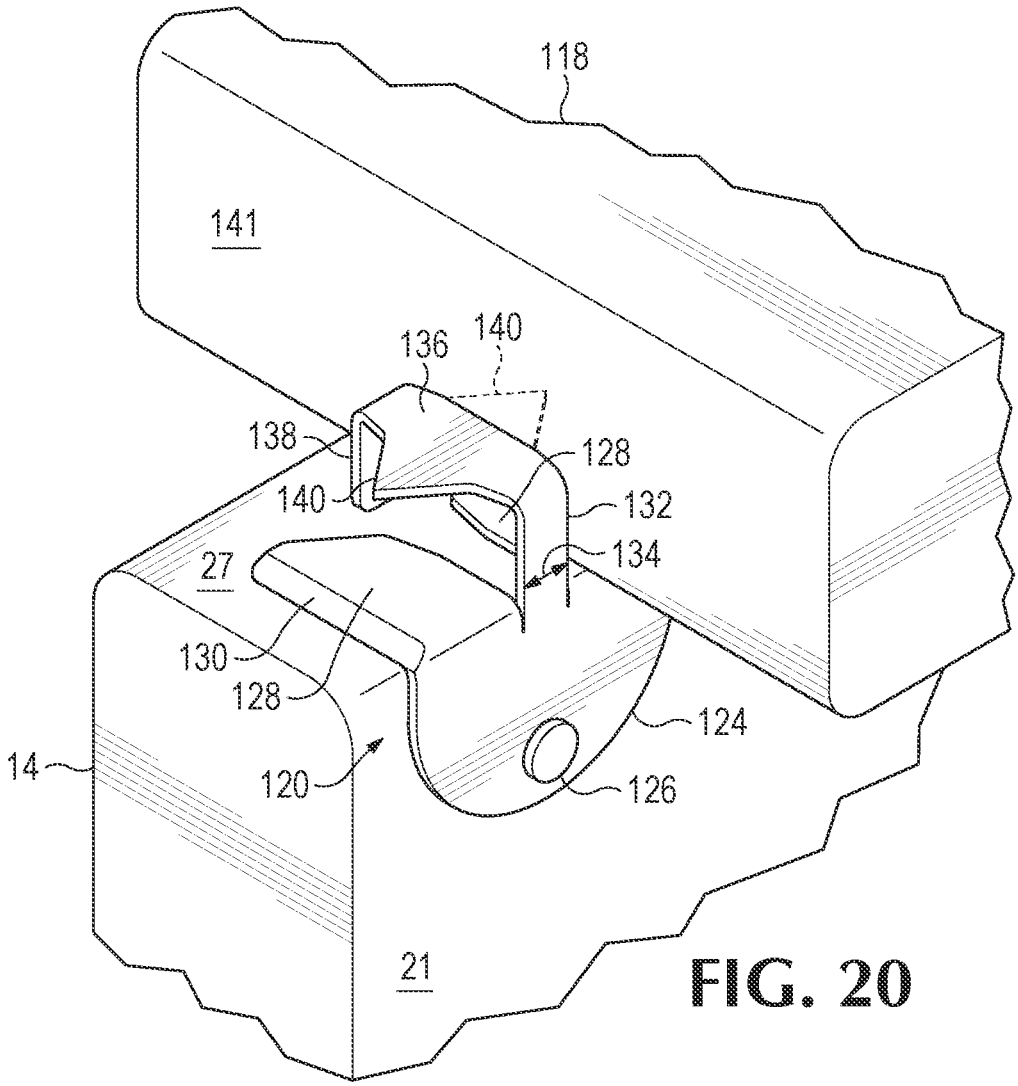
FIG. 20 is an isometric view of a portion of a deck frame joist with a deck board resting atop the joist and held in place by a sheet metal hold-down device that is nailed to the joist.
Figure 21:
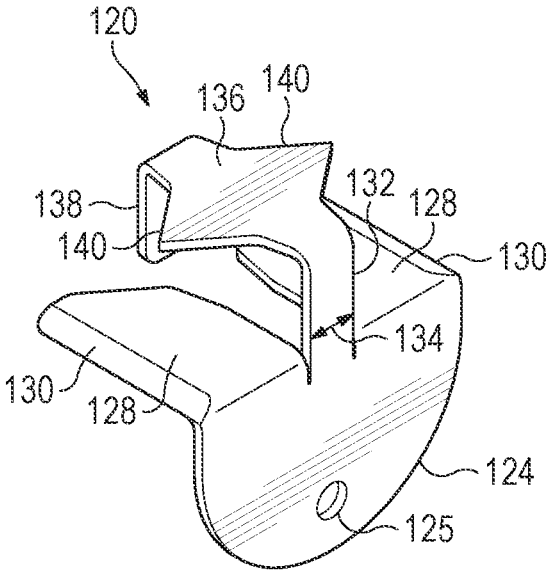
FIG. 21 is an isometric view of the hold-down device shown in FIG. 20.

As shown in FIG. 19, a hold-down device 112 similar to the hold-down device 110 can be manufactured of a significantly thicker sheet metal, or of plastics or composite material, in which case the easy strike tabs 100 would be impractical. An opening 114 may be provided in members 92 as shown in FIG. 19.

For use in mounting deck boards 118 that may be of wood that is flat on all four sides hold-down devices 120 and 122 of two separate but similar configurations are shown in FIGS. 20-27. The hold-down device 120 shown in FIGS. 20-22 may be of sheet metal construction. It may include a planar attachment member 124 defining a fastener hole 125 and may be fastened, as by a nail 126 or a screw, to a vertical side 21 of a joist 14 or equivalent member of a deck supporting structure. A pair of height-setting arms 128 that may be portions of the same sheet metal piece extend perpendicularly from the attachment member 124 so that when the hold-down device 120 is installed the arms 128 may rest atop an upper face 27 of a joist 14 or equivalent member of a deck supporting structure. Edges 130 of the arms 128 may be chamfered to facilitate moving a deck board 118 against a hold-down device 120 that is mounted on a joist 14.

A spacer neck 132, having a width 134 equal to the distance intended to separate adjacent ones of deck boards 118 to be attached using the hold-down device 120, may be coplanar with and extend upward from the attachment member 124 by a distance that may be about half the thickness of the deck board 118. A right-angle bend is formed at an upper end of the spacer neck 132 and a deck board engagement member 136 extends from the spacer neck parallel with the height-setting arms 128 and the top face 27 of the joist 14. A spacer leg 138 having a width equal to the width of the spacer neck 132 may extend perpendicularly downward, parallel with the attachment member 124, from an opposite side of the deck board engagement member 136. The spacer leg 138 may have a length short enough not to reach the top surface 27 of a joist 14.

Figure 22:
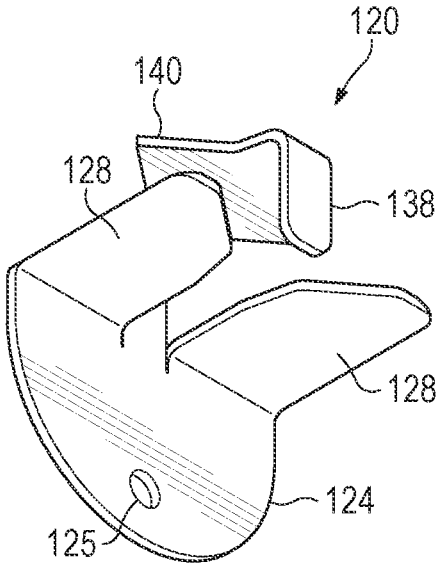
FIG. 22 is an isometric view of the hold-down device shown in FIG. 21, taken from a different direction.

A deck board 118 attached to the joist 14 by the hold-down device 120 rests atop one of the height-setting arms 128 while a respective one of a pair of oppositely-directed pointed tabs 140 of the deck board engagement member 136 extends into the adjacent lateral or edge face 141 of the deck board 118, as seen in FIG. 22. Once a first deck board 118 has been installed a hold-down device 120 may be installed on the lateral side of the deck board where a subsequent deck board 118 will be placed. The tabs 140 of the hold-down device 120 will pierce and extend into the exposed lateral face 141 of the mounted deck board 118, as the hold-down device 120 is driven toward the installed deck board 118 and the chamfered edge 130 leads the height-setting arm 128 beneath the deck board 118. Once the hold-down device 120 is seated in the deck board 118 with the spacer neck 132 and the arm 138 in contact with the deck board 118, an appropriate fastener such as a nail 126 may be driven into the joist 14 through the hole 125 in the attachment member 124 of the hold-down device 120 to complete the attachment of the deck board 118 to the deck supporting structure.

The fastened hold-down device 120 is then left in position against a deck board 118, ready for a subsequent deck board 118 to be placed in position adjacent the fully fastened deck board. The subsequent deck board 118 is then driven into place so that the other point tab 140 of the deck board engaging member 136 extends into the newly placed subsequent deck board 118, and the newly placed deck board is in contact against the exposed opposite edge of the spacer neck 132.

Figure 23:
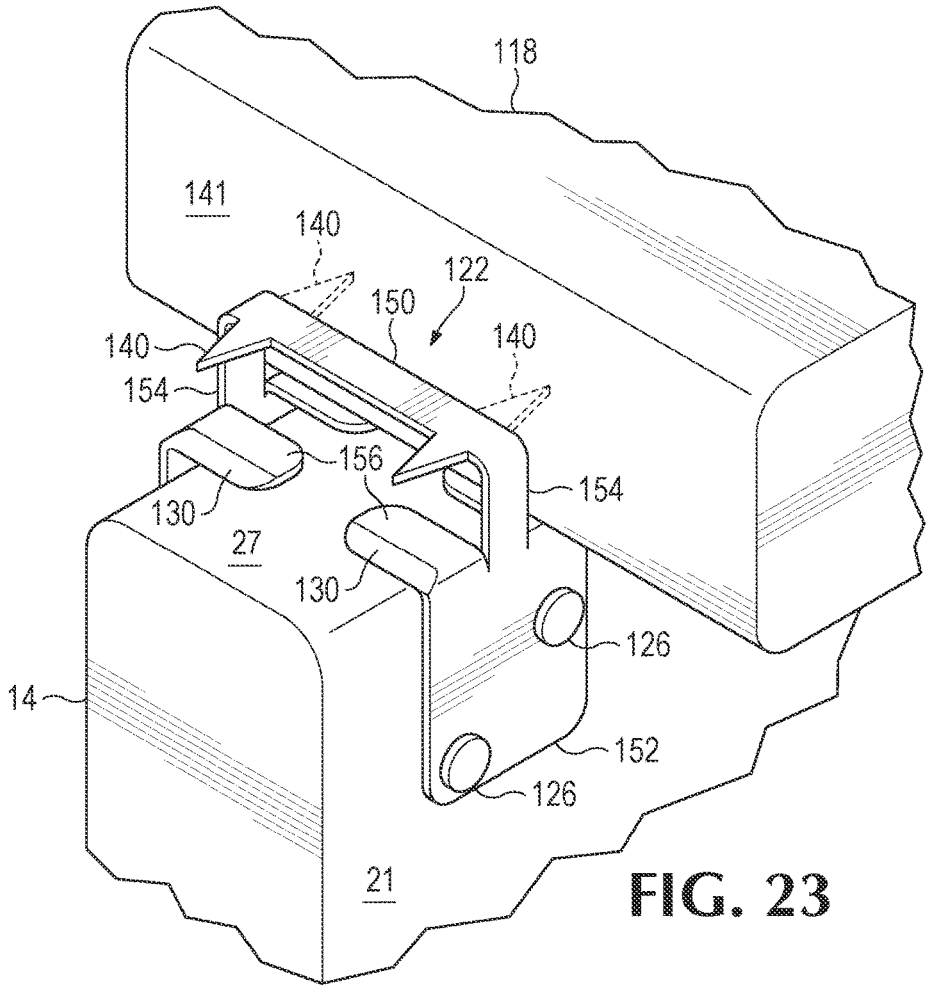
FIG. 23 is an isometric view of a portion of a deck frame joist with a deck board resting atop the joist and held in place by a hold-down device that extends downward along both sides of the joist.
Figure 24:
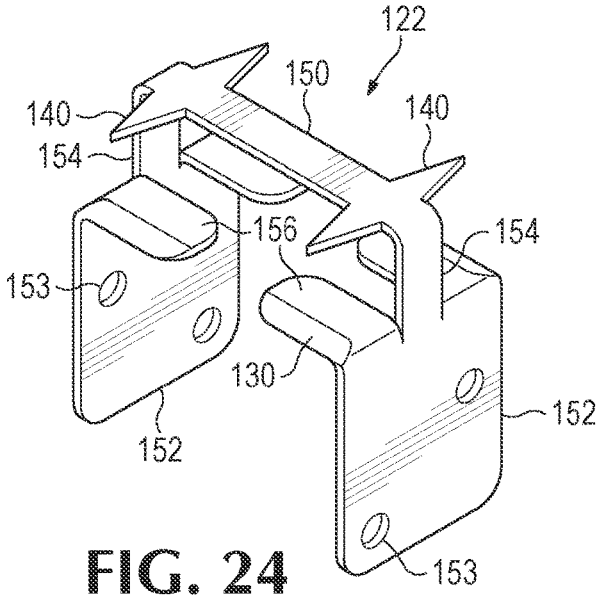
FIG. 24 is an isometric view of the hold-down device shown in FIG. 23.
Figure 25:
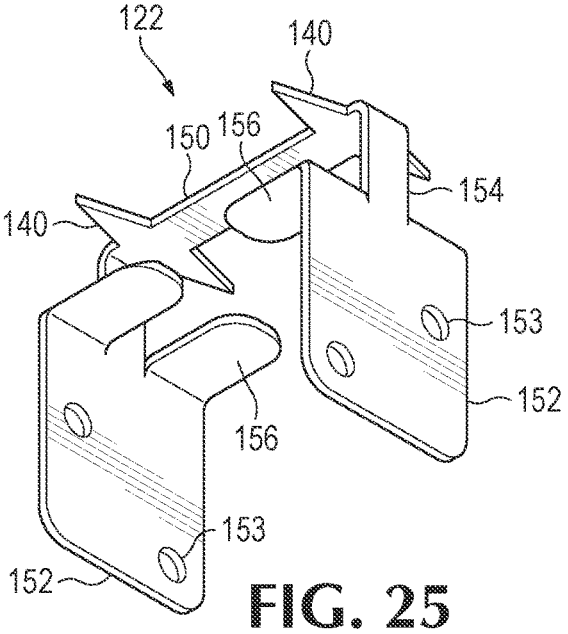
FIG. 25 is an isometric view of the hold-down device shown in FIGS. 23 and 24, taken from an opposite direction.

A hold-down device 148 shown in FIGS. 23-25 includes a pair of point tabs 140 on each of a pair of opposite lateral sides of an engagement member 150. Each of a pair of similar, oppositely located parallel attachment members 152 includes a pair of holes 153 to receive fasteners such as nails or screws. A spacer neck 154 extends upwardly and in a coplanar orientation from each of the opposite attachment members 152 to a right-angle bend toward the deck board-engagement member 150. A pair of height-setting arms 156 extends from each attachment member 152 to rest on the top surface 27 of a joist 14 on which the hold-down device 148 is mounted, as shown in FIG. 23. The manner of installation and use of the hold-down device 148 is similar to that described for the hold-down device 120.

Figure 26:
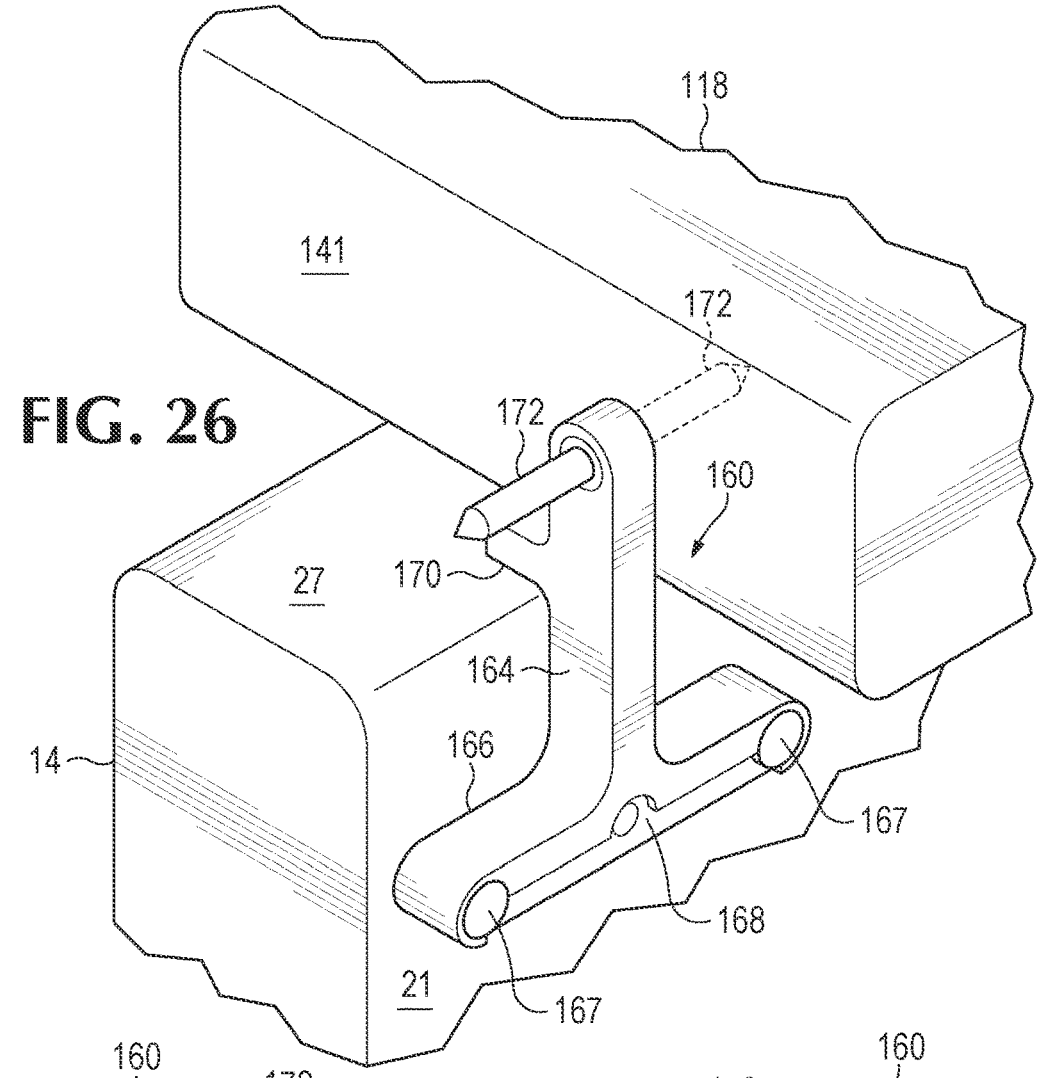
FIG. 26 is an isometric view of a portion of a deck frame joist with a deck board resting atop the joist and held in place by a hold-down device constructed partially of molded material and incorporating a sharp pin extending in each of two opposite directions.
Figure 27A:
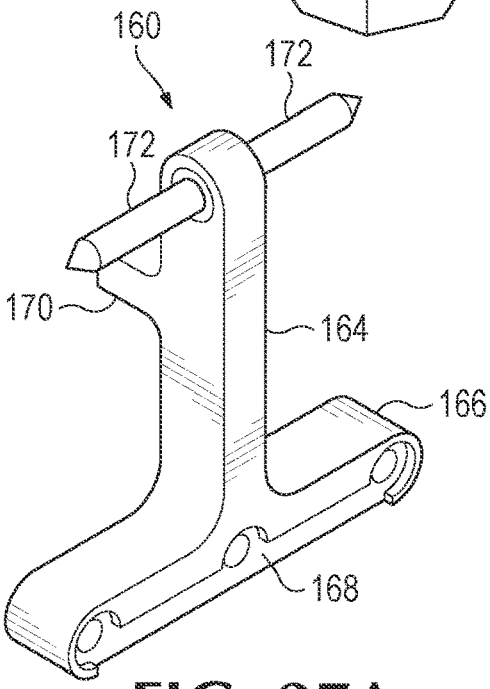
FIG. 27A is an isometric view of the hold-down device shown in FIG. 26.
Figure 27B:
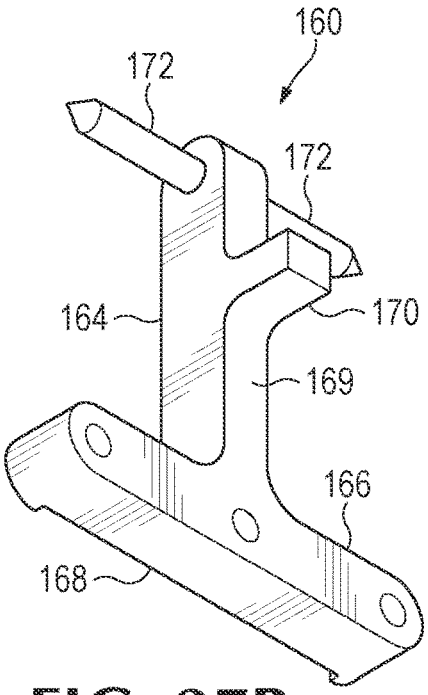
FIG. 27B is an isometric view of the hold-down device shown in FIGS. 26 and 27A, as seen from an opposite direction.
Figure 30:
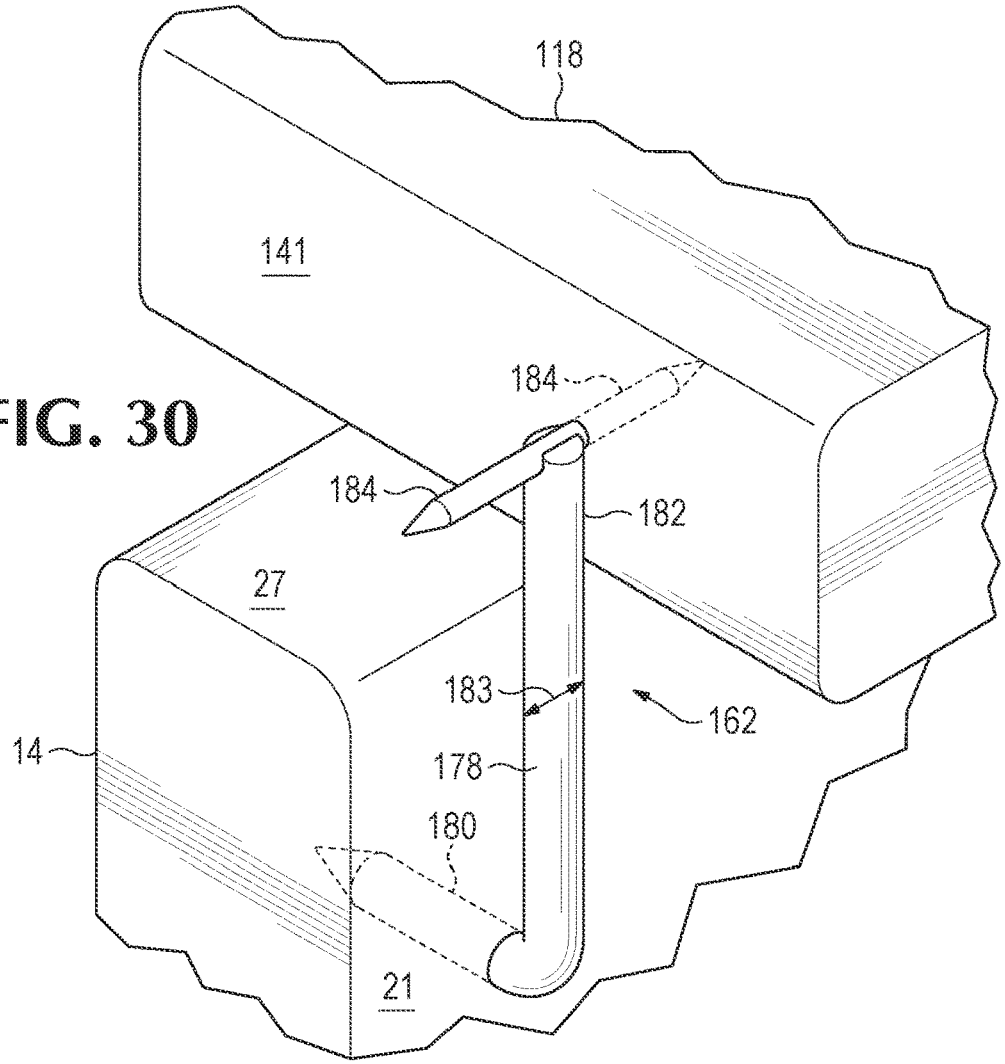
FIG. 30 is an isometric view of a portion of a deck frame joist with a deck board resting atop the joist and held in place by a hold-down device including a pointed shank driven into the joist and a double-ended sharpened pin extending in opposite directions from an upper end of the shank, and with one end of the pin engaged in an adjacent edge face of the deck board.
Figure 31:
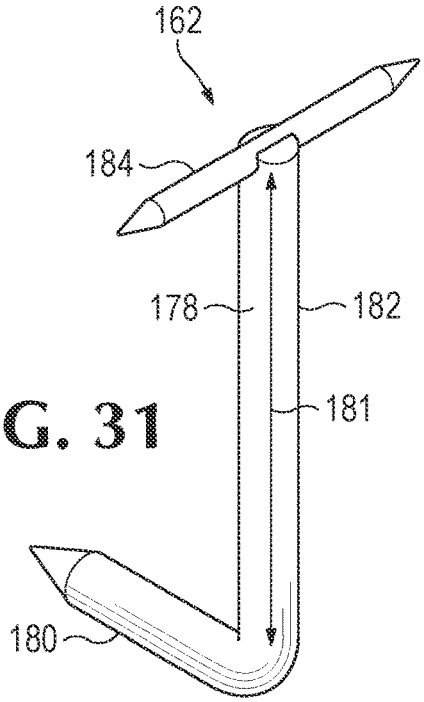
FIG. 31 is an isometric view of the hold-down device shown in FIG. 30.
Figure 32:
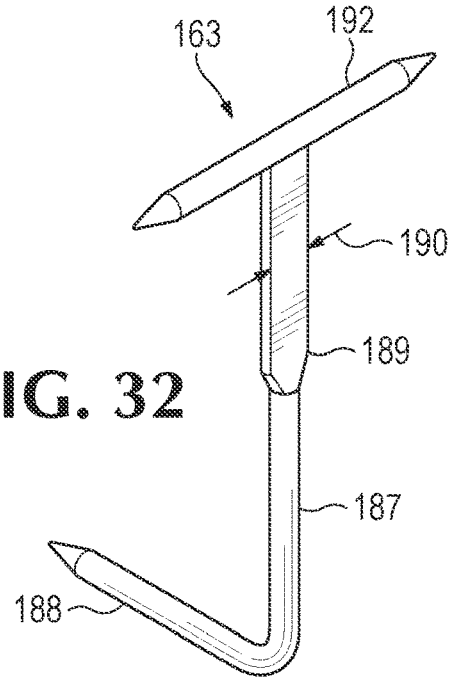
FIG. 32 is an isometric view of a hold-down device that is a variation of the device shown in FIGS. 30 and 31.

Functionally similar deck board hold-down devices 160, 162, and 163 are shown in FIGS. 26, 27A and 27B, and in FIGS. 30-32. A hold-down device 160 has a body of molded material such as plastics or composite material including a spacer neck 164 extending upward from a fastener-receiving attachment member 166. The attachment member 166, as in the hold-down device 70 described shown in FIGS. 10-12, is capable of receiving up to three fasteners 167 such as nails, with the heads of such fasteners protected in recesses 168 so as not to tend to lead moisture along such a fastener and into the joist. A planar face 169 of the spacer neck 164 is intended to fit snugly against a vertical side surface 21 of a joist 14 or equivalent member of a deck supporting structure. A height-setting arm 170 extends perpendicularly from the spacer neck, and thus horizontally when the hold-down device is in use, so as to rest on the top surface 27 of the joist 14 or other structural support member between deck boards 118 and thus to position a sharp-pointed nail-like deck board-engagement member 172, mounted in an upper end of the spacer neck 164, at approximately the level of the middle of the thickness of a deck board 118. The deck board engagement member extends laterally on each side so as to pierce a lateral face 141 of a deck board 118.

The deck board engagement members 172 may be similar to a pair of nails extending in opposite directions from the upper end of the spacer neck 164, so that the opposite deck board engagement members 172 extend parallel with the length of the joist 14 and thus directly toward and into the lateral faces 141 of adjacent deck boards 118.

Figure 28:
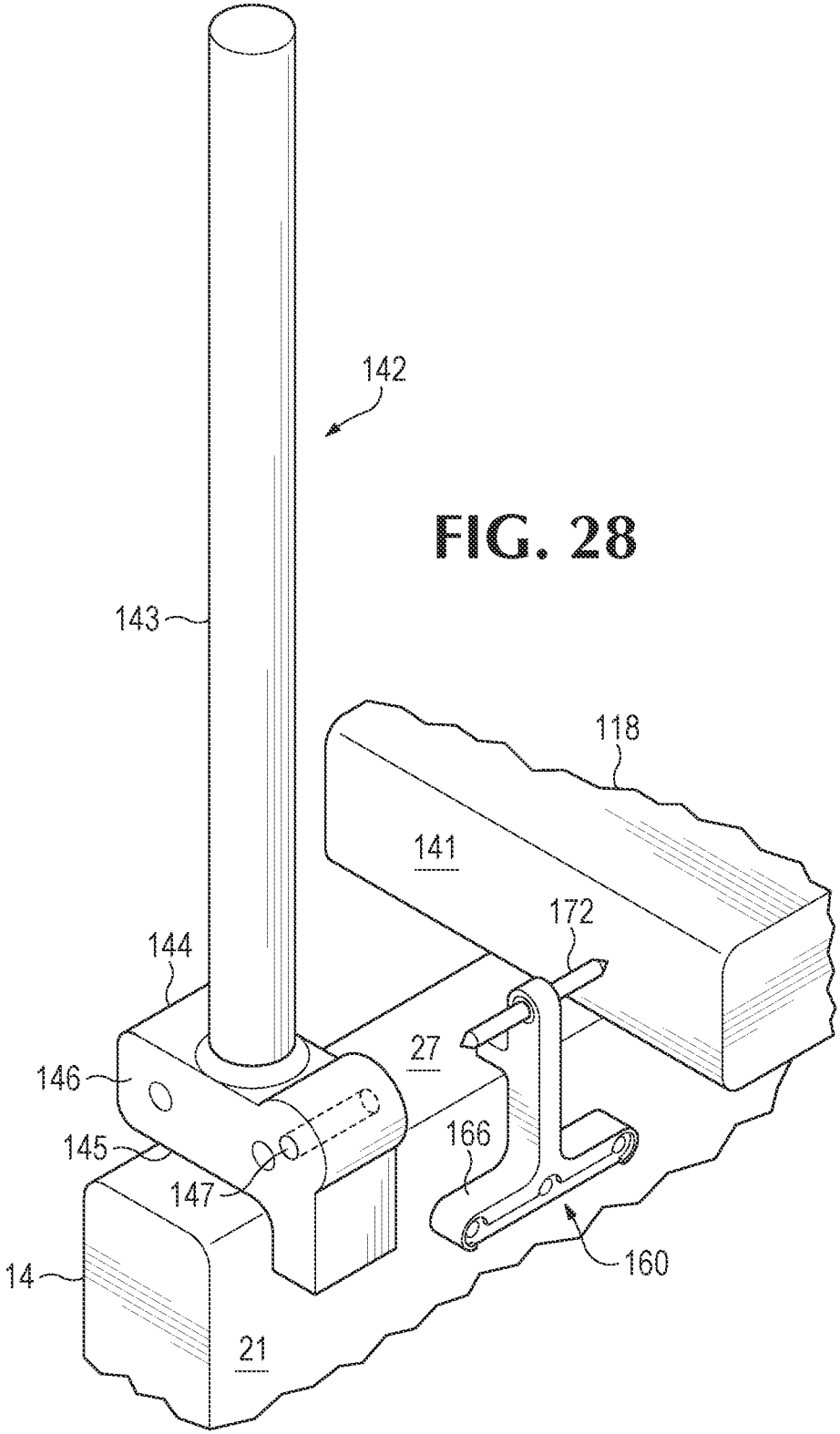
FIG. 28 is an isometric view of a portion of a deck frame joist, with a deck board resting atop the joist and a hold-down device similar to that shown in FIGS. 26, 27A, and 27B located alongside the joist and a tool that may be used to install the hold-down device resting atop the joist.
Figure 29:
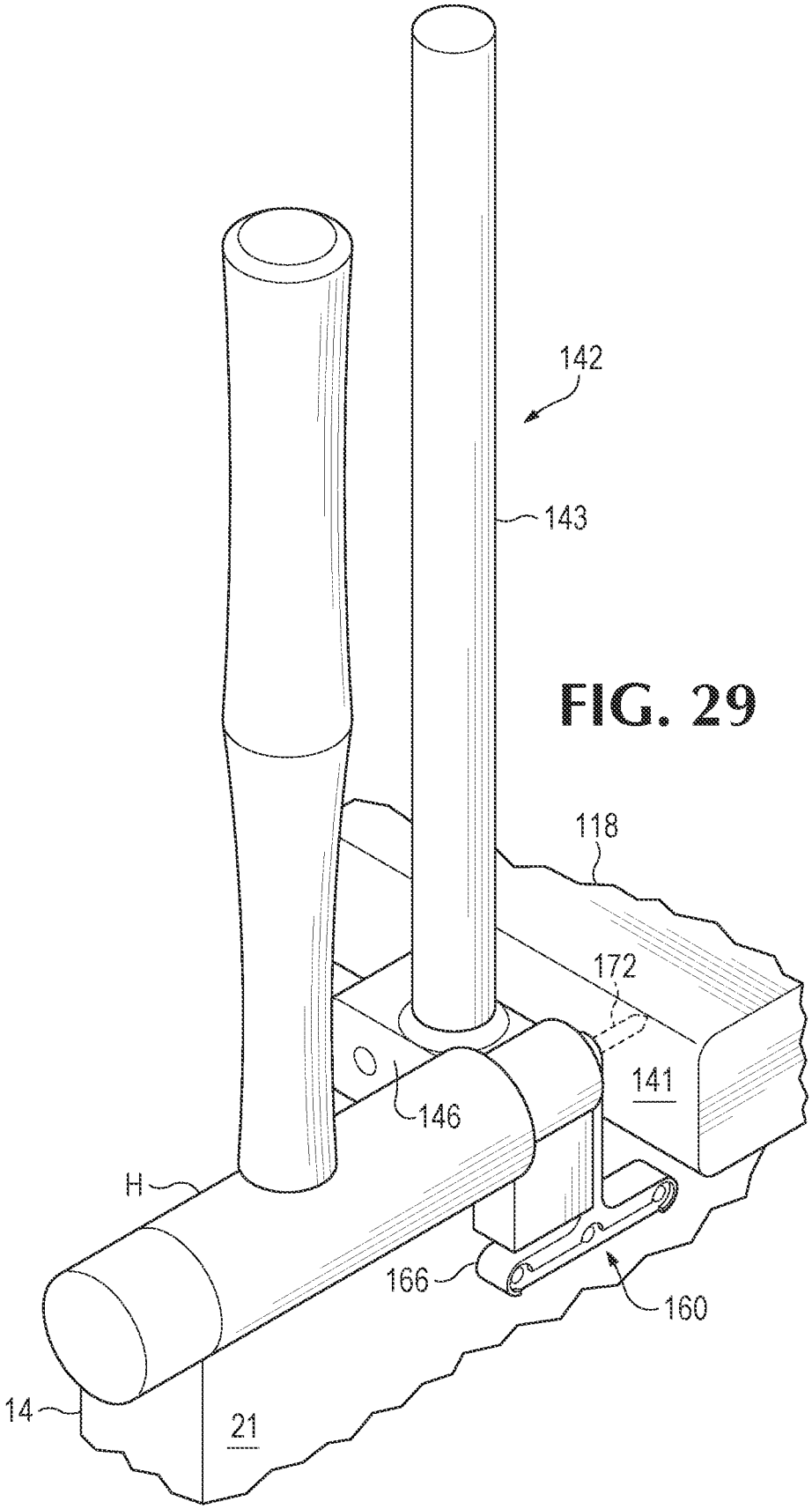
FIG. 29 is an isometric view of the portions of a deck joist and deck board and the tool shown in FIG. 28, and with a hammer having driven the hold-down device into the deck board.

The tool 142 shown in FIGS. 28 and 29 may be used to engage the hold-down device 160 with a first deck board 118 before the attachment member 166 is fastened to the vertical face 21 of the joist 14. The tool 142 has a head 144 mounted on a handle 143, and a bottom face 145 of the tool head is shaped to rest on the top face 27 of the joist 14. The tool head 144 includes a hole 147 located to receive the deck board-engagement member 172, leaving a face 146 of the tool head 144 available to be driven by a hammer H, so that the deck board-engagement member 172 will be driven straight into the edge face 141 of the deck board 118.

Once the attachment member is fastened to the joist 14 a subsequent deck board 118 may be driven toward and into engagement with the hold-down device 160 until the lateral face 141 of such a subsequent deck board 118 contacts the spacer neck 164 and the other engagement member 172 is engaged in the subsequent deck board 118.

The hold-down device 162 shown in FIGS. 30 and 31 is functionally similar but of simpler construction. A metal rod 178 includes a right-angle bend, with a short, pointed portion functioning as an attachment member 180 that can be driven into a vertical face 21 of a joist 14 or other member of a deck support structure. A spacer neck portion 182 of the rod 178 has a length 181 and a diameter 183 equal to a desired spacing between deck boards 118. The spacer neck portion 182 extends upward alongside the joist 14 as shown in FIG. 30 when the hold-down device 162 is in use. At an upper end of the spacer neck is a double-ended deck board engagement member 184 similar to the board engagement member 172 included in the hold-down device 160 described above and shown in FIGS. 27-29. The deck board engagement member 184 may be clamped into an appropriate notch in the upper end of the spacer neck 182, and may also be welded in place to provide ample security to hold a deck board 118 down atop a joist 14 as shown in FIG. 30.

As shown in FIG. 32 a similar device hold-down device 163 includes a rod 187 of smaller diameter as the attachment member portion 188, defined by a right-angle bend, and an upper spacer portion 189 of the rod 187 may be forged into a flattened and wider configuration having a board-spacing width 190, and it functions as a spacer neck portion of the hold-down device. The nail-like, sharpened, deck board engagement member 192 is similar to that in the hold-down device 162 shown in FIGS. 30 and 31, and may be welded in place at the upper end of the spacer neck portion 189 of the hold-down device 163 as shown in FIG. 32.

Figure 33A:
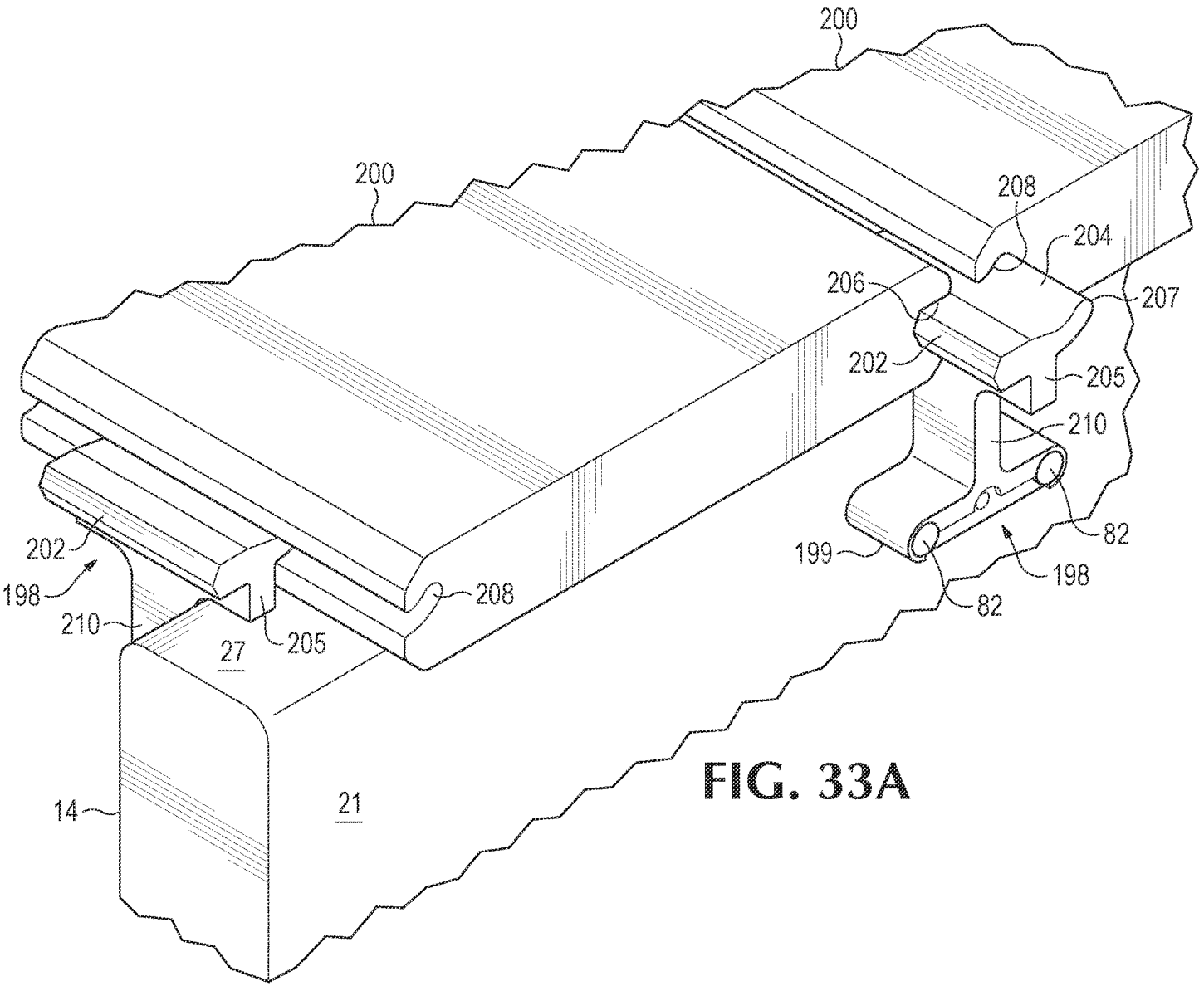
FIG. 33A is an isometric view of a portion of a deck frame joist and portions of a pair of deck boards resting atop the joist and held in place by hold-down devices of molded plastic construction fastened to vertical side surfaces of the joist and engaged in grooves provided in the lateral edge faces of the deck boards.
Figure 33B:
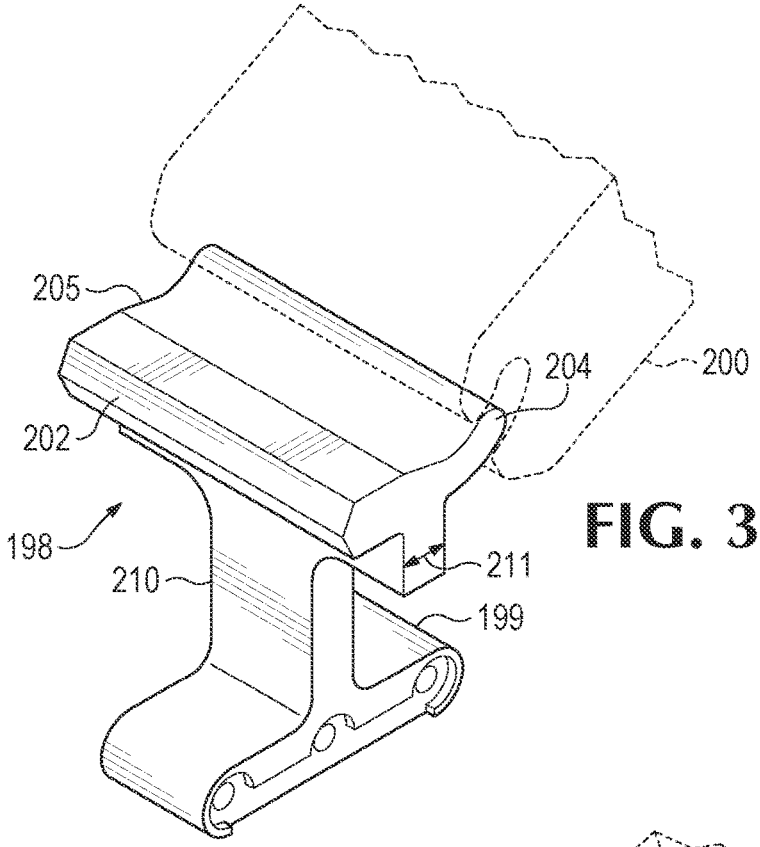
FIG. 33B is an isometric view of the hold-down device shown in FIG. 33A, together with a portion of a deck board of special configuration intended to be utilized with the hold-down device, shown in phantom view.
Figure 33C:
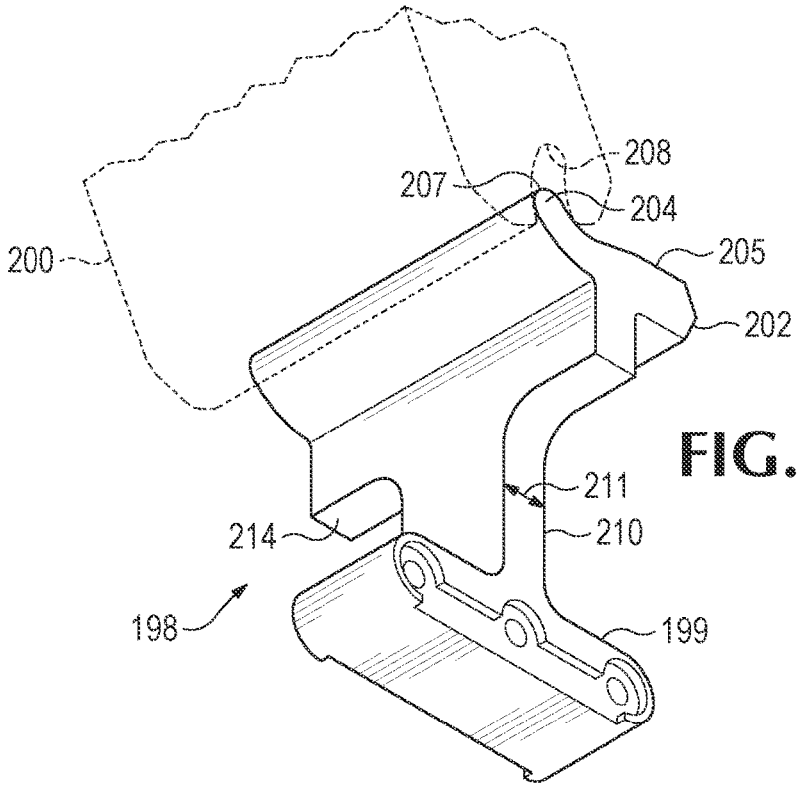
FIG. 33C is an isometric view of the hold-down device and the portion of a deck board shown in FIGS. 33A and 33B as seen from an opposite direction.

A deck board hold-down device 198 shown in FIGS. 33A-33C may be used to fasten specially configured deck boards 200 to a joist 14 or equivalent support member of a deck-supporting structure. The hold-down device 198 may be of molded material such as plastics or composite material and is somewhat similar to the hold-down device 70 described above and shown in FIGS. 10-12. The attachment member 199 has recessed locations for heads of fasteners 82 such as nails or screws on both sides, so the hold-down device 198 can be mounted on either side of a joist 14 or equivalent member of a deck support structure.

Deck board engagement members or wings 202 and 204, on opposite sides of a body portion 205, are different from each other. A first engagement member 202 extends straight and horizontal when in place, similar to a tongue of tongue-and-groove lumber. A curved wing-like second engagement member 204 is a variation of such a tongue, extending in the opposite direction away from the engagement member 202, toward an adjacent deck board. The second engagement member 204, rather than simply being similar to a flat tongue of a tongue-and-groove board, is upwardly curved, and has a rounded nose 207 in the embodiment of the device 198 depicted here.

A deck board 200 is specially shaped for use with the hold-down device 198, and may be of wood or composite plastics construction or other material. The deck board 200 includes specially designed grooves 206 and 208 formed in opposite lateral edge faces. Thus a groove 206 on a first lateral edge face of a deck board 200 may extend straight into the deck board 200 parallel with the top and bottom surfaces of the deck board 200 similar to the groove of tongue-and-groove lumber, and may be of a shape and size to receive the first engagement member 202 with a snug fit.

A groove 208 in the opposite lateral edge face of the deck board 200 is shaped specially to receive the curved second engagement member 204. A groove 208 of a deck board 200 can thus easily be mated with the curved engagement member 204 of a hold-down device 198 already fastened to a joist 14, by presenting the deck board to the hold-down device 198 tilted, with the groove 208 facing toward the curved wing-like engagement member 204 and the groove 206 spaced upwardly apart from the top surface 27 of the joist 14, as shown in phantom view in FIGS. 33B and 33C. Once the groove 208 is initially placed to receive the curved engagement member 204, the deck board 200 can be lowered and pushed toward the hold-down device 198 to bring the deck board 200 into its intended position resting atop the deck joist 14 and parallel with the adjacent deck board 200. A spacer neck 210, with a width 211 equal to a desired inter-board spacing, and the body portion 205 between the engagement members 202 and 204 then establish and maintain the required spacing, between adjacent deck boards 200. A bottom surface 214 of the body portion 205 is intended to rest on the top surface 27 of the joist 14, and is located so as to place the engagement members 202 and 204 at the correct height above the top surface 27 to engage the grooves 206 and 208, with the deck boards 200 of the corresponding design resting on the top surface 27 and held securely in place by the hold-down devices 198. The deck boards 200 are thus held securely in place without any fasteners piercing the deck boards 200 and providing paths for moisture to proceed into the top faces 27 of deck support structure members such as the joists 14.

Figure 34A:
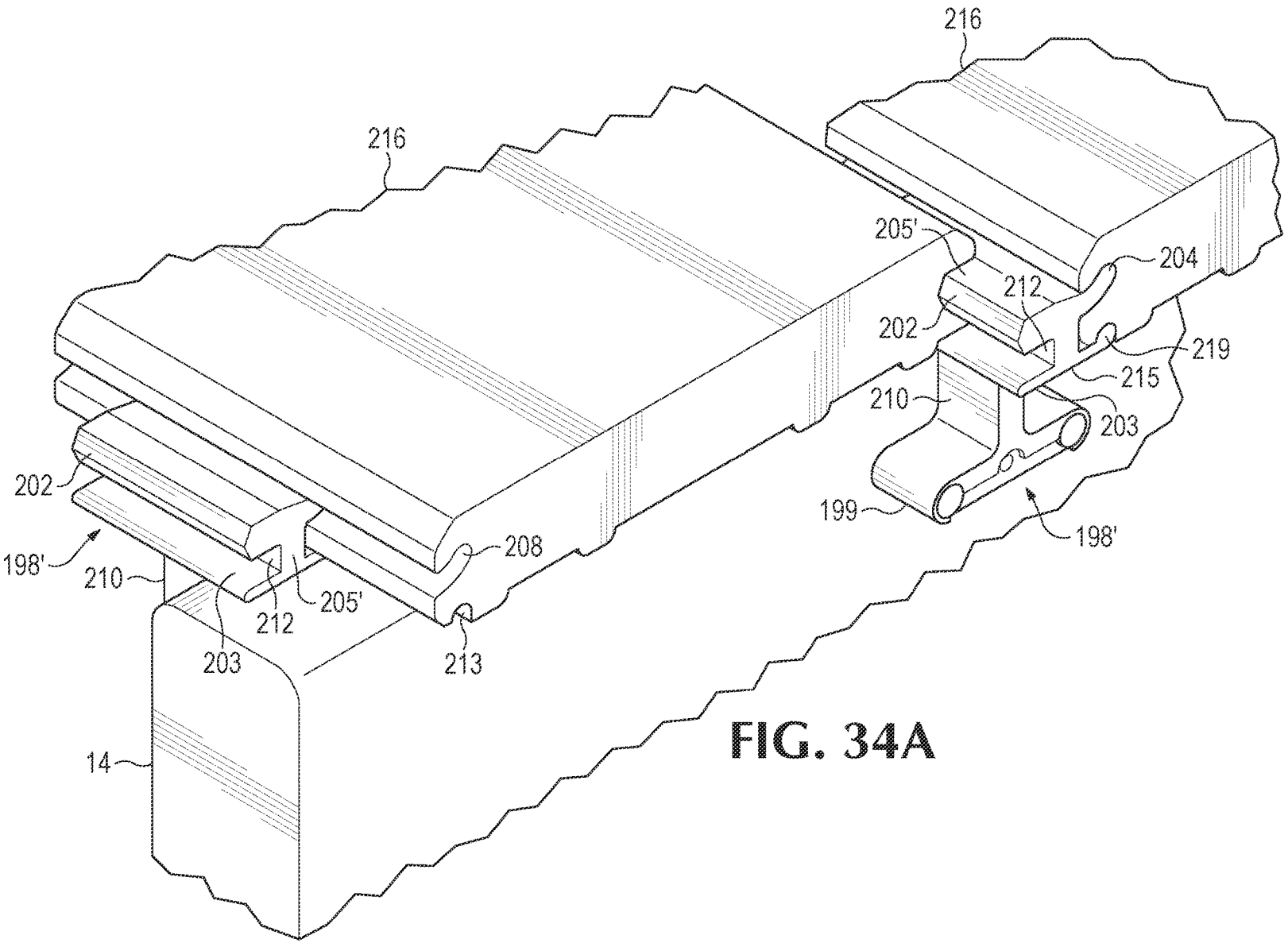
FIG. 34A is an isometric view of a portion of a deck frame joist and portions of a pair of deck boards resting atop the joist and held in place by hold-down devices of molded plastic or composite construction fastened to vertical side surfaces of the joist and engaged in grooves provided in the lateral edge faces of the deck boards.
Figure 34B:
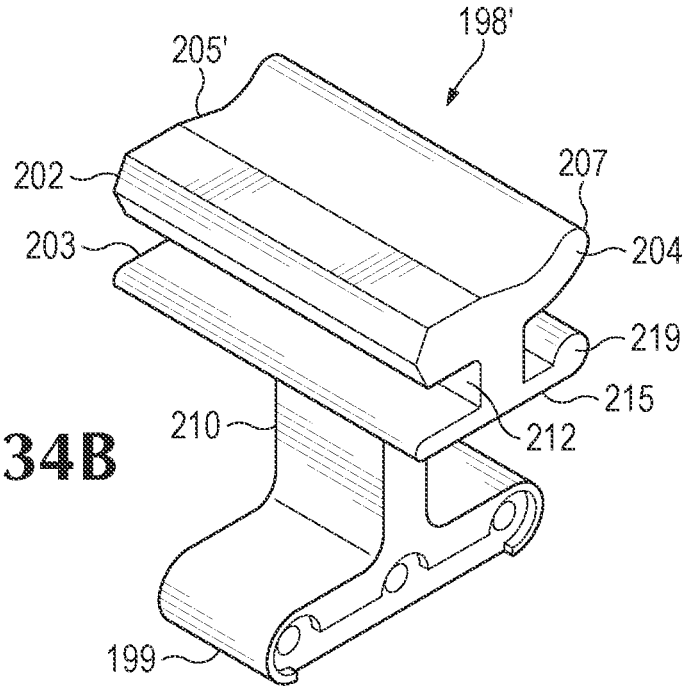
FIG. 34B is an isometric view of one of the hold-down devices shown in FIG. 34A.
Figure 34C:
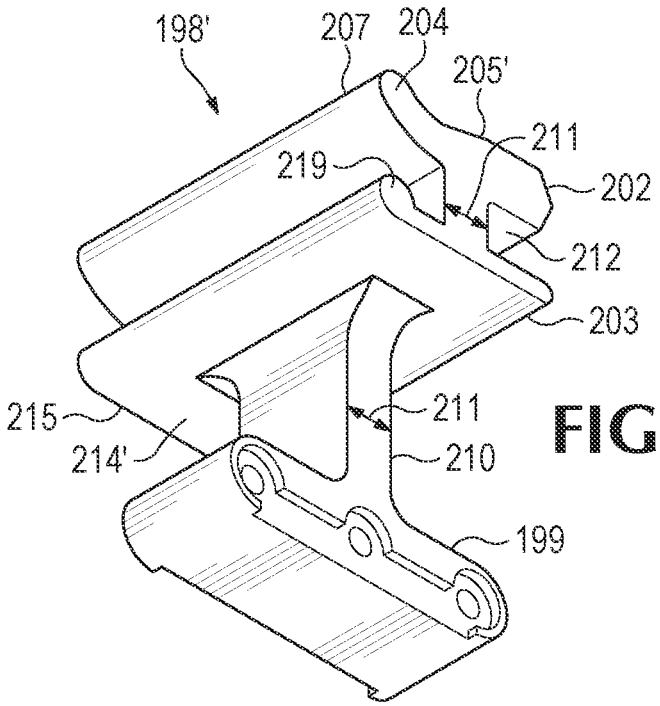
FIG. 34C is an isometric view of the old-down device shown in FIG. 34B, as seen from an opposite direction.

FIGS. 34A, 34B, and 34C disclose a hold-down device 198' that is in many respects similar to the hold-down device 198. The body portion 205' differs from the body 205 portion of the hold-down device 198 by including a shelf 203 located below and parallel with the engagement member 202. The shelf 203 is relatively thin, with a thickness of, for example, 0.25 cm, and is located in position to rest atop the top surface 27 of a joist 14. A space 212 is provided between the shelf 203 and the engagement member 202 to receive a lower portion of the cooperatively configured deck board 216 defining the straight groove 206. A bottom portion of the deck board 216 may be shaped to receive the shelf 203 as may be seen in FIG. 34A.

Located on the opposite side of the upper body portion 205 'of the hold-down device 198' is a shelf portion 215 including a raised, enlarged, lip 219 located beneath and extending parallel with the upwardly-curved engagement member 204. A deck board 216 designed and shaped to fit cooperatively with and to latch into engagement with the hold-down device 198' may include a groove 213 of a size and shape intended to receive and be engaged by the lip 219. The deck board 216 may be tilted and moved into mating engagement with the upwardly-curved engagement member 204 and then lowered to a horizontal orientation parallel with the upper surface 27 of the deck support joist 14 in substantially the same manner in which a board 200 may be mated with the curved wing-like engagement member 204 of the hold-down device 198. As the deck board 216 is lowered and rotated downward the lip 219 or the material defining the groove 213, or both, will elastically flex enough for the lip 219 to snap into a latching retaining engagement in the groove 213.

Figure 35A:
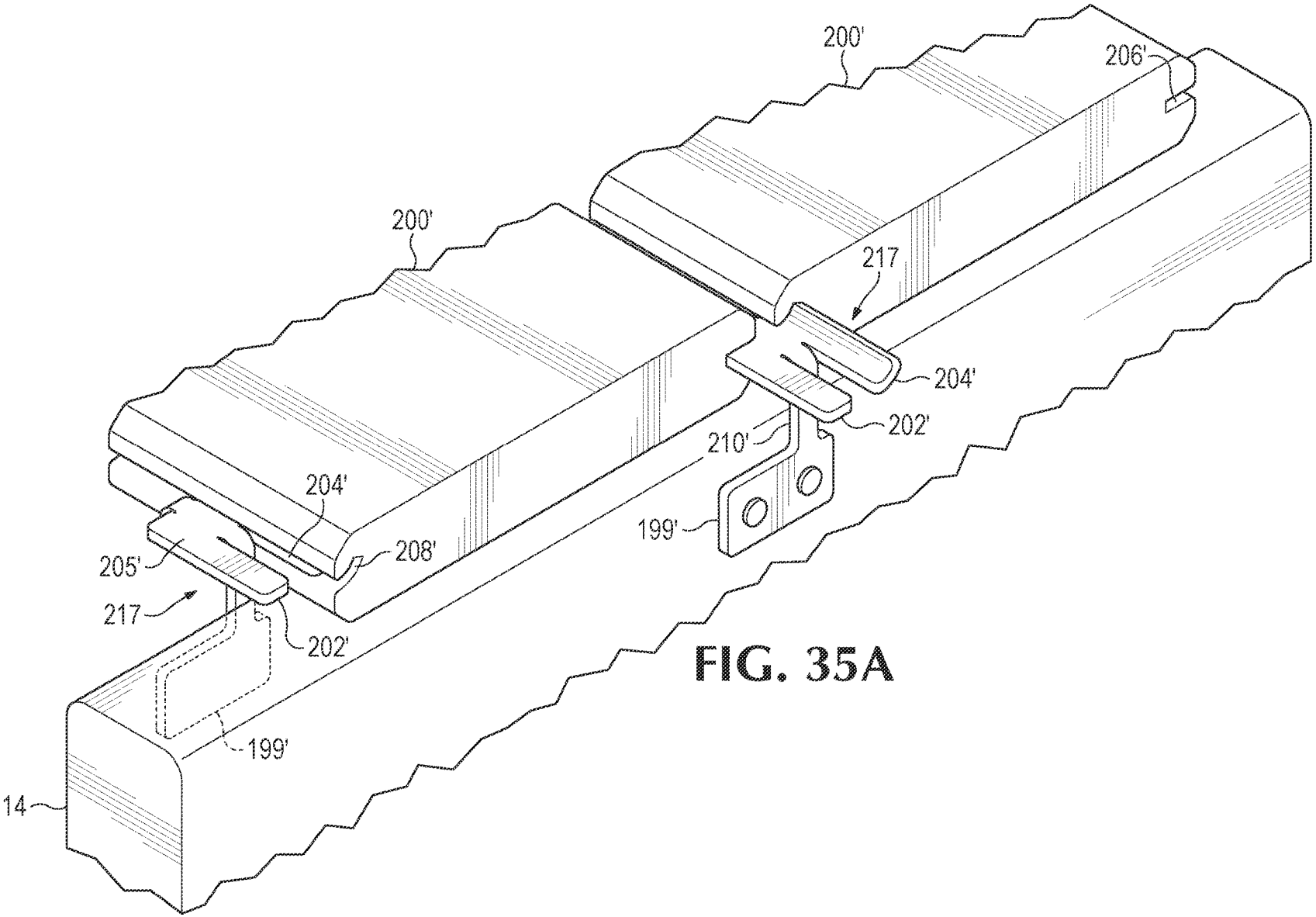
FIG. 35A is an isometric view of a portion of a deck frame joist and portions of a pair of deck boards resting atop the joist and held in place by a pair of hold-down devices of sheet metal construction fastened to vertical side surfaces of the joist and engaged in grooves provided in the lateral edge faces of the deck boards.
Figure 35B:
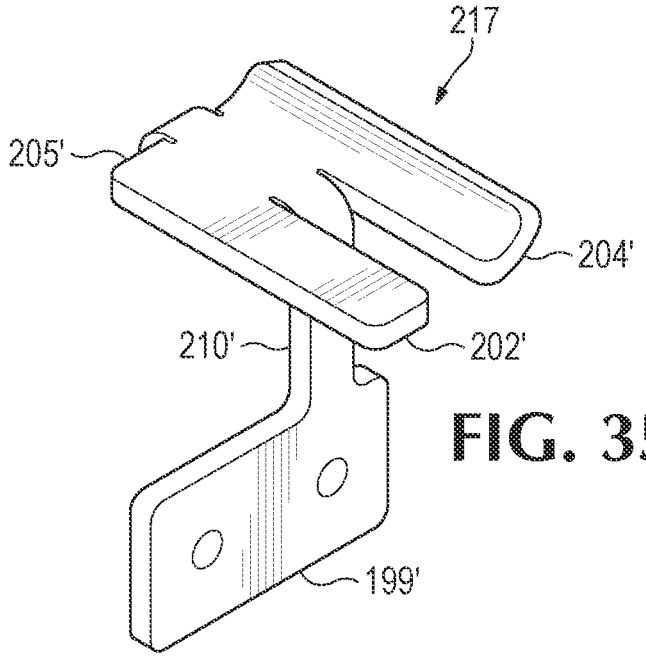
FIG. 35B is an isometric view of one of the hold-down devices shown in FIG. 35A.
Figure 35C:
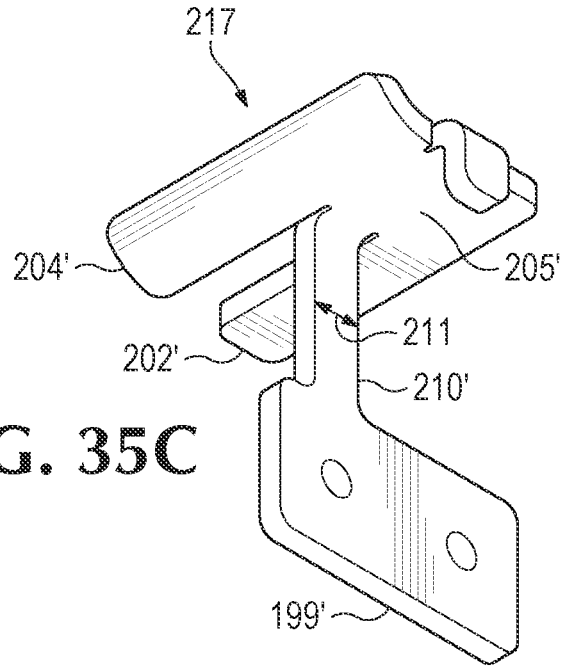
FIG. 35C is an isometric view of the hold-down device shown in FIG. 35B, as seen from an opposite direction.

As shown in FIGS. 35A, 35B, and 35C, a hold-down device 217 equivalent to the hold-down device 198 may be made of sheet metal, and has an equivalent configuration, with a straight, generally planar engagement wing 202' and an upwardly curved engagement wing 204' on opposite sides of a spacer neck 210'. Deck boards 200' may be of molded composite material construction or of wood, but must be of a configuration capable of mating with the hold-down devices 217, as will be understood presently.

An attachment member 199' at the bottom end of the spacer neck 210' extends over a greater distance on one side of the spacer neck than on the other and defines a pair of holes for receiving fasteners 82 such as nails or screws to conveniently mount the hold-down device 217 to the vertical face 21 of a joist 14. As may be seen in FIG. 35A, the shape of the attachment member 199' facilitates mounting the hold-down device 217 on either side of the joist 14. It will be understood that a straight slot 206' and a curved slot 208' defined in the lateral face of a deck board 200' should be only slightly wider than the thickness of the material of which the hold-down device 217 is made, so as to receive respectively the engagement wing 202' and the curved wing 204' snugly.

Figure 35D:
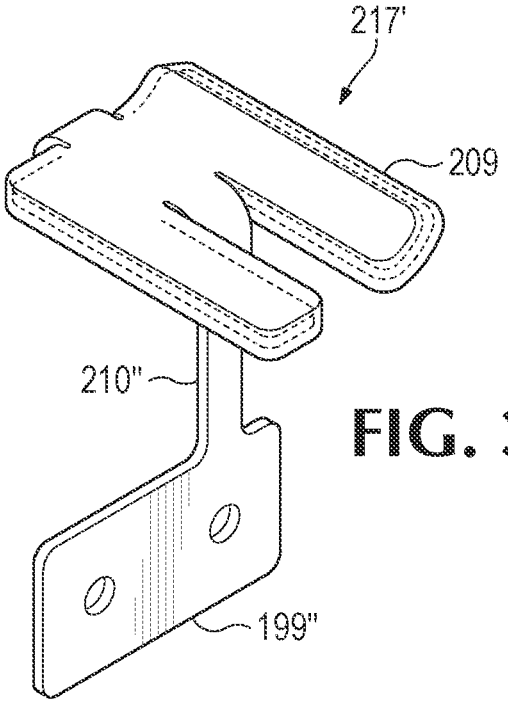
FIG. 35D is an isometric view of a hold-down device similar to the one shown in FIGS. 35A, 35B, and 35C, in which a portion of the device is covered with material such as molded plastics material configured to mate with a deck board having a particular configuration.
Figure 35E:
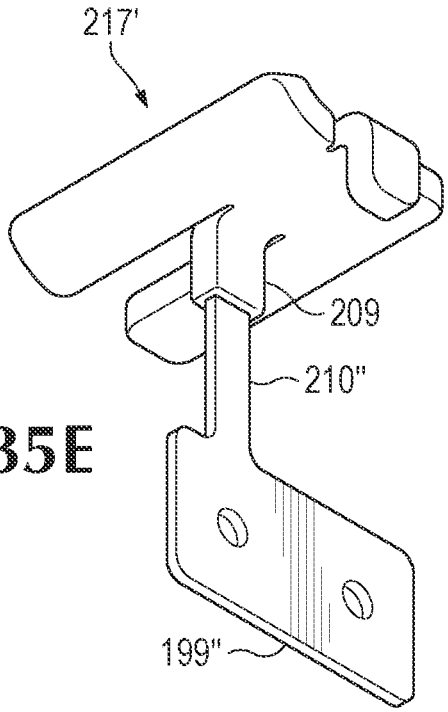
FIG. 35E is an isometric view of the hold-down device shown in FIG. 35D, as seen from an opposite direction.

Because many different chemicals are used in pressure treatment of various varieties of wood that might be used as supporting members 14 of a deck, the attachment of some hold-down devices made of plastics or composite materials to such supporting members may result in chemical reactions with the composite materials of such hold-down devices and therefore may not be advised. Some pressure treatment chemicals may react with certain plastics in a way that might weaken or damage the plastics. In order to assure that hold-down devices do not deteriorate, hold-down devices 217' functionally similar to hold-down devices 217 and various hold-down devices made of composite materials, such as devices 50, 70, 106, 112, 198, and 198' disclosed above may be manufactured in a modified form as illustrated in FIGS. 35D and 35E in which portions that will be in contact with treated lumber of supporting structures for a deck, such as a spacer neck 210 and an attachment member 199", are manufactured of metal, such as galvanized steel. Portions of the hold-down devices 217' that will be in contact with deck boards, which may be of composite material and are not commonly of pressure treated lumber, may include plastics materials 209, molded over or otherwise attached to an extension of the metal attachment member portion 199" that serves as a core or armature to support the plastics materials 209 with sufficient strength.

In a deck board attachment system 218, illustrated in FIGS. 36A-44, rather than engage a lateral side or edge face of a deck board, hold-down devices such as securing clips 220 and a starter clip 222 are engaged in corresponding slots defined in the bottom faces of deck boards 224 and 226 specially designed and prepared for use with such deck board hold-down securing clips 220 and 222. That is, deck boards 224 and 226 may be designed as stock items to be used with the deck board securing clips described below, to build a deck with boards securely attached to supporting structure of the deck. The deck boards can be fastened to support members with designed spacing between boards and without forming holes through the deck boards or into the supporting joists that would lead moisture down into deck joists and the like. A primary deck board securing clip 220 in this attachment system may be made of sheet metal and may include a base or main body portion 228 that defines a base plane 229 and rests atop a joist 14 or equivalent member of a deck supporting structure, as may be seen in FIGS. 36A and 36B. An attachment member 230 is oriented downward, perpendicular to the main portion 228, so as to be fastened snugly alongside and in contact with a vertical side 21 of a joist 14. The attachment member 230 defines one or more fastener holes 232 to receive a fastener such as a screw or nail extending horizontally into the joist 14 to attach the deck board securing clip 220 to the joist 14 without creating a downward path for moisture into the support structure of the deck.

Figure 36A:
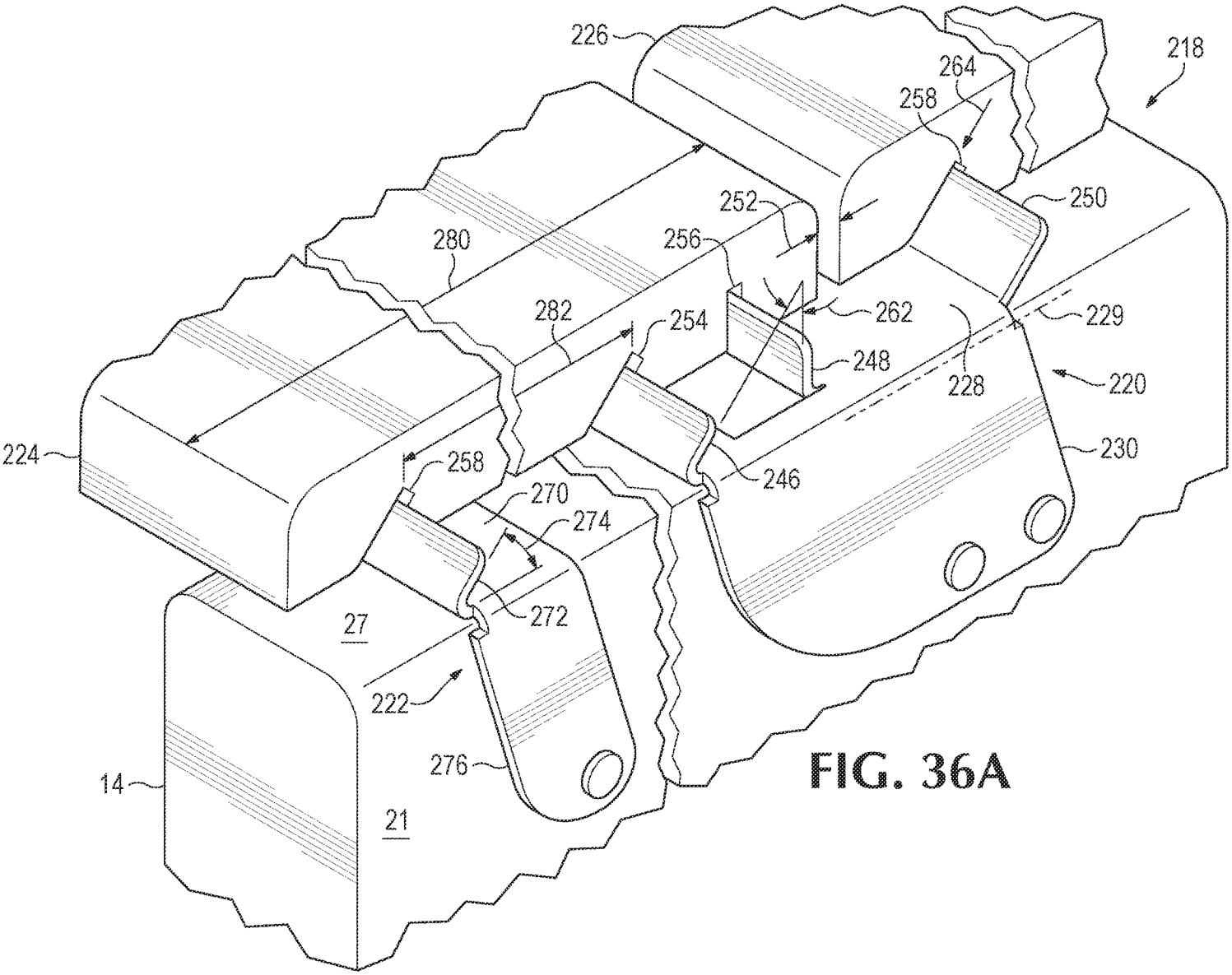
FIG. 36A is an isometric view of a portion of a deck frame joist, with the ends of two deck boards resting atop the joist and held in place by hold-down devices that engage grooves formed in the bottom faces of the deck boards.
Figure 36B:
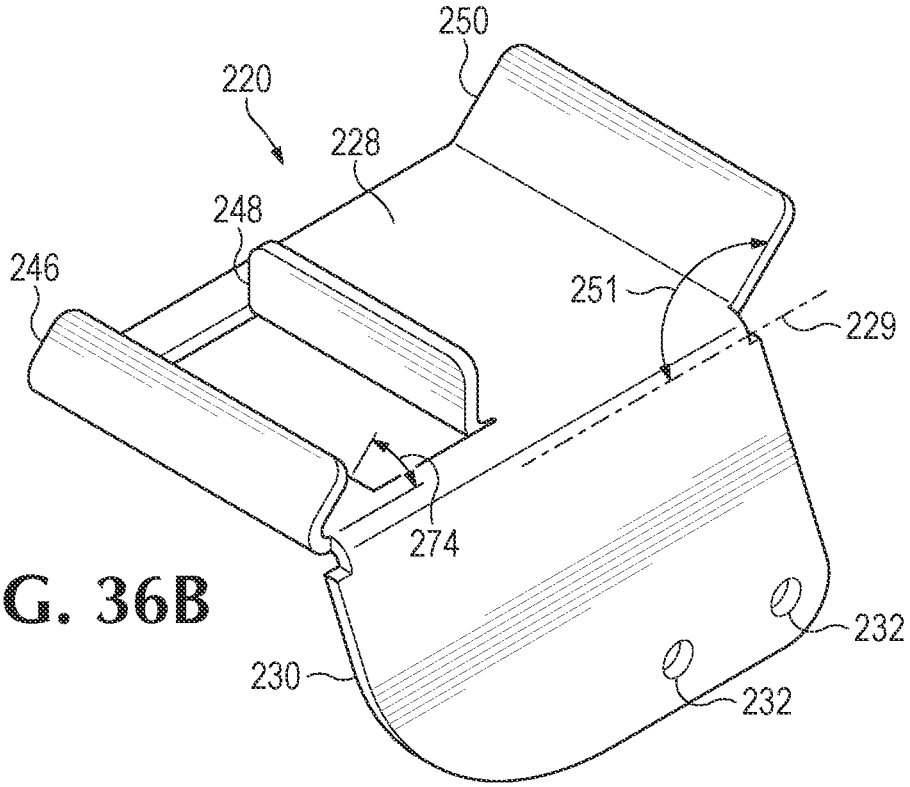
FIG. 36B is an isometric view of one of the hold-down devices shown in use in FIG. 36A.
Figure 36C:
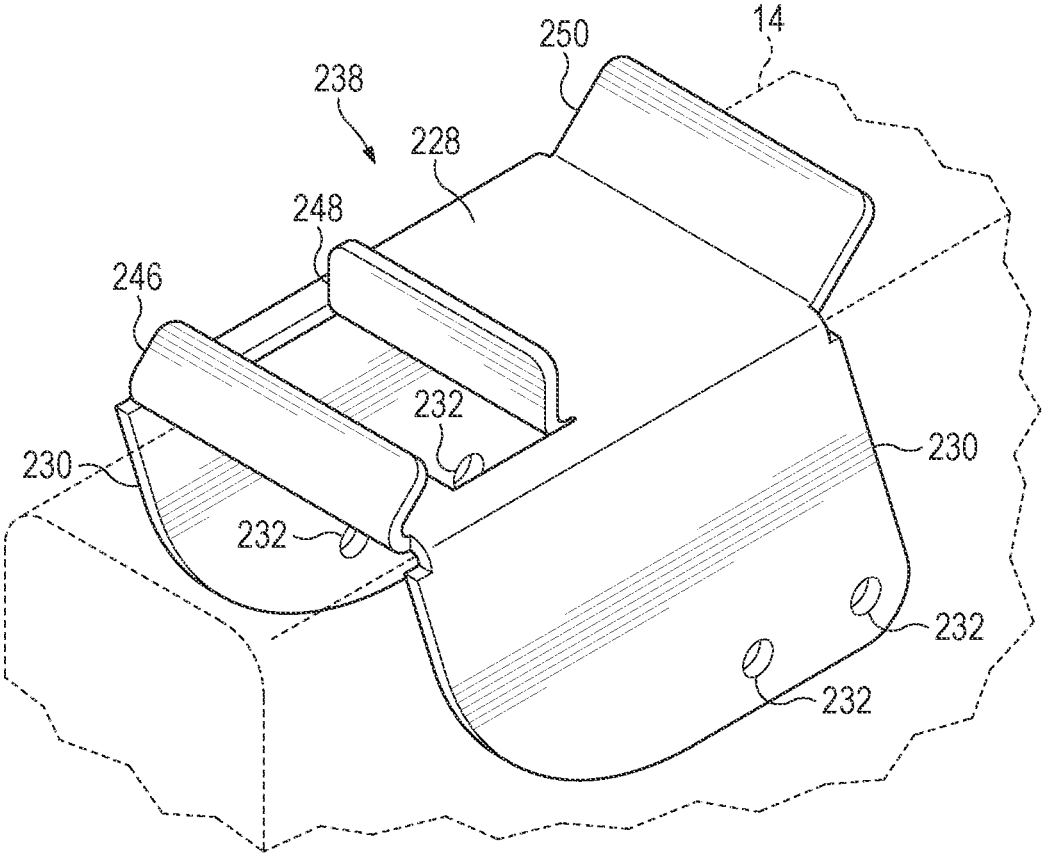
FIG. 36C is an isometric view of a hold-down device that is a variation of the hold-down device shown in FIG. 36B.

As shown in FIG. 36C, a deck board hold-down securing clip 238 may include a pair of attachment members 230 extending downward parallel with each other from opposite sides of the main body portion 228. The attachment members 230 may be spaced apart from each other by a distance slightly greater than the width of the joist 14 or other member of the deck support structure on which such a deck board securing clip 238 is to be mounted, and the fastener holes 232 are offset from each other.

Protruding from the main portion 228 of the primary deck board securing clip 220 or 238 are three deck board-anchoring fins 246, 248, and 250. The first and second fins 246 and 248 are located so as to engage a first deck board 224, and the third fin 250 is intended to engage a separate deck board 226. The third find 250 is oriented at an obtuse angle 251 to the base plane 229 and is inclined away from the fins 246 and 248, so as to facilitate placement of another deck board 226 into a position alongside and parallel with the first deck board 224. A desired spacing 252 between the first and second deck boards 224, 226 is determined by the spacing between fins 248 and 250 and the locations of corresponding slots 254, 256, and 258 in the bottom faces of the first and second deck boards 224 and 226, as may be seen in FIG. 36A.

In the securing clip 220 shown in FIG. 36A the roots of the deck board attachment fins 246, 248, and 250 on the main body portion 228 of the deck board securing clip 220 extend parallel with each other and transversely along the base plane 229 of the main body portion 228 of the clip 220. That is, they extend parallel with the length of deck boards 224 and 226 and are oriented perpendicular to a joist 14 on which the deck board securing clip 220 is mounted as shown in FIG. 36A. It will be understood that it may be desirable for deck boards to be oriented at a different angle, such as 45°, to the length of the joists 14 or other members of a deck support structure. For that reason, a deck board securing clip (not shown) can have the roots of attachment members 230 oriented accordingly on the main portion 228, as will be understood.

In order to prevent the deck boards 224 from being raised away from the support structure with which the deck board securing clip is used, the first and second attachment fins 246 and 248 extend upwardly away from the main portion 228 of the securing clip 220 at different angles, so that they preferably converge toward each other or diverge away from each other by an angle 262 differing from parallelism by at least 20° and preferably by 30°-60° and optimally by 45°, as shown in FIG. 36. Thus, when the first and second fins 246 and 248 are engaged respectively in the correspondingly oriented slots 254 and 256 defined in the bottom face of a deck board 224 or 226 the lack of parallelism prevents the deck board from being moved up away from the main portion 228 of the clip 220. As shown in FIGS. 36A-36B, the first fin 246 is oriented at an angle 264 of 45° to the base plane 229, and the second fin 248 projects perpendicularly away from the main body base plane 229 of the main body portion 228. The first fin 246 as shown is inclined toward the second fin 248, at an acute angle 264 to the plane of the main body 228. The first fin 246 could be oriented instead at an obtuse angle to the plane 229 of the main body 228, so long as the resulting diversion from parallelism with the second fin 248 is at least about 20°. Alternatively, the first fin 246 might project perpendicularly from the main body 228 and the second fin 248 might be oriented at an inclination toward the first fin 246, making it unnecessary to bend either fin through as large an angle with respect to the main portion of the securing clip during manufacture. That orientation may contribute to ease of manufacture of the securing clip 220 from sheet metal.

The third fin 250, as shown, is oriented to project upwardly at an obtuse angle 251 and obliquely away from the first and second fins 246 and 248 and the main body portion 228 of the deck board securing clip 220, and thus is inclined at an angle upward and toward a subsequent deck board 226 that may be mounted on the joist 14. This permits the subsequent deck board 226, with a deck board securing clip 220 already in place in slots 254 and 256 of the deck board 226, to be slid diagonally down onto the joist 14, in the direction of the arrow 264 and toward a deck board 224 that has already been secured to the joist by the securing clip 220, so that the third deck board-engaging fin 250 enters the third slot 258 of the deck board 226. The attachment members 230 of the separate securing clip 220 (not shown) already engaged with the deck board 226 can then be fastened to the joist 14 to secure the deck board 226 to the joist 14.

A starter deck board hold-down securing clip 222 includes a base 270 and a deck board-engaging fin 272 extending along the base 270 and projecting away from the base portion 270 at an acute angle 274 that should be the same as the orientation of the third fin 250 and the third slot 258 in the deck board 224, as shown in FIG. 36A. The fin 272 can be received in the corresponding slot 258 as the deck board 224 is being secured to the joist 14. The starter clip 222 may have a depending attachment member 276 to be fastened to the side 21 of the joist 14 by a nail 278 or similar fastener. The joist 14 and the deck board 224 are shown foreshortened in FIG. 36, and it will be understood that the distance between the starter securing clip 268 and the primary clip 220 can vary according to the actual width 280 of the deck board 224 and the consequent distance 282 between the first slot 254 and the second slot 256 in the deck board 224.

Figure 37:
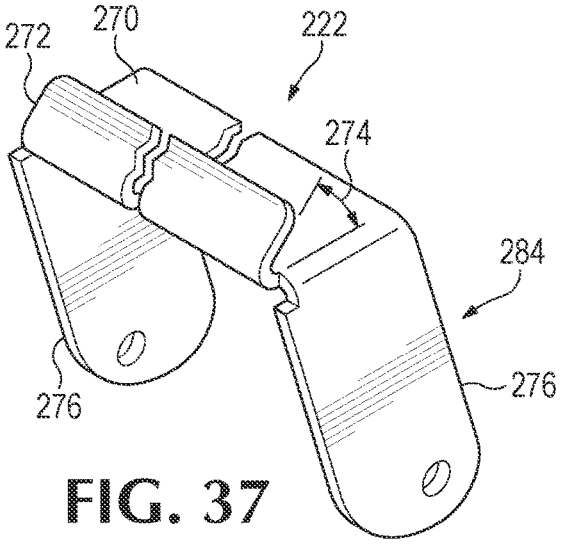
FIG. 37 is an isometric view of one of the hold-down devices shown in use in FIG. 36A.
Figure 38A:
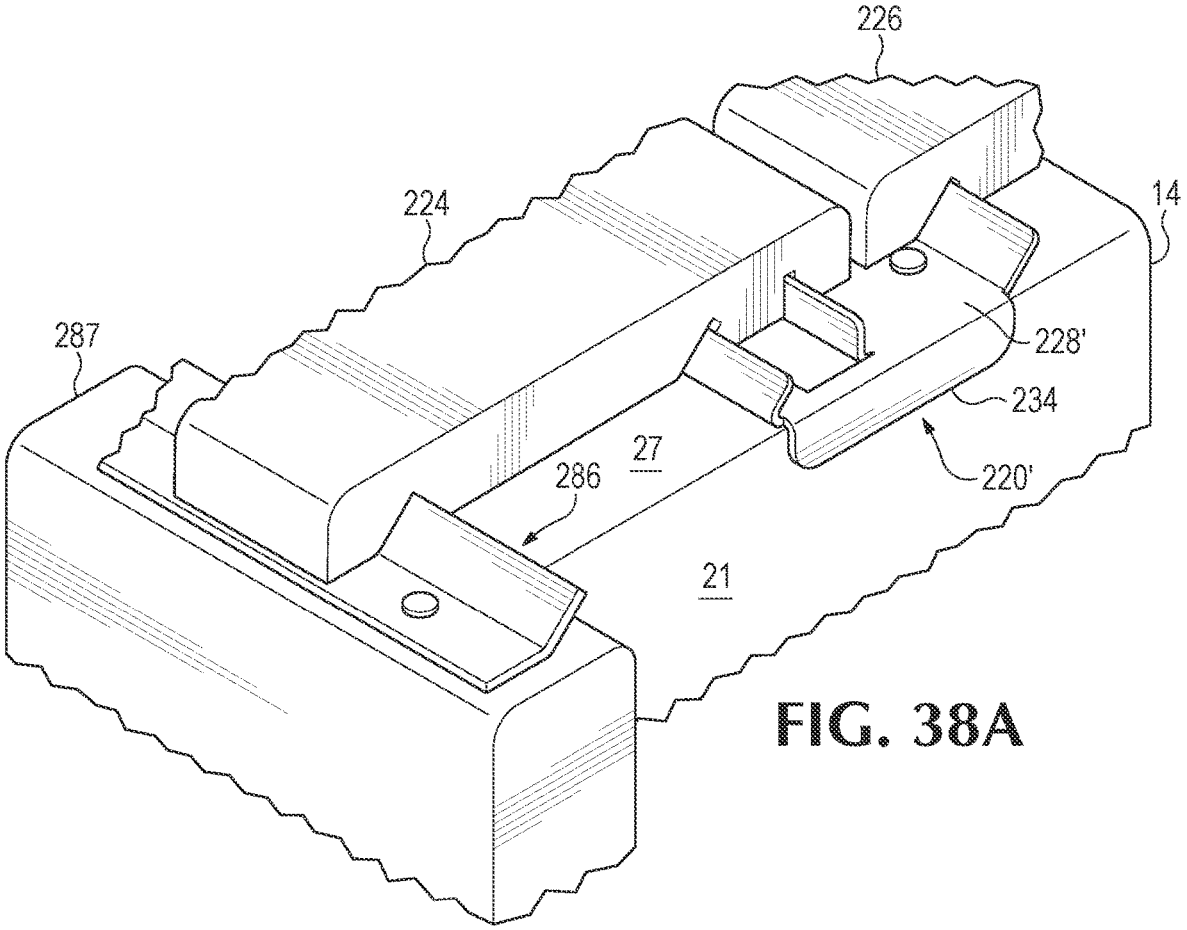
FIG. 38A is an isometric view of a portion of a deck frame including a pair of intersecting joists, with the ends of a pair of deck boards resting atop the joists and held in place by hold-down devices that engage grooves formed in the bottom faces of the deck boards.
Figure 38B:
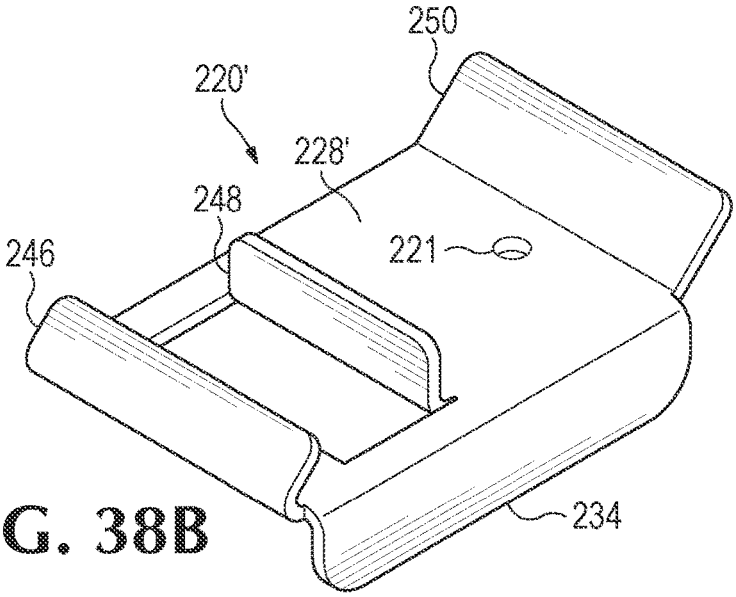
FIG. 38B is an isometric view of one of the hold-down devices shown in FIG. 38A.
Figure 38C:
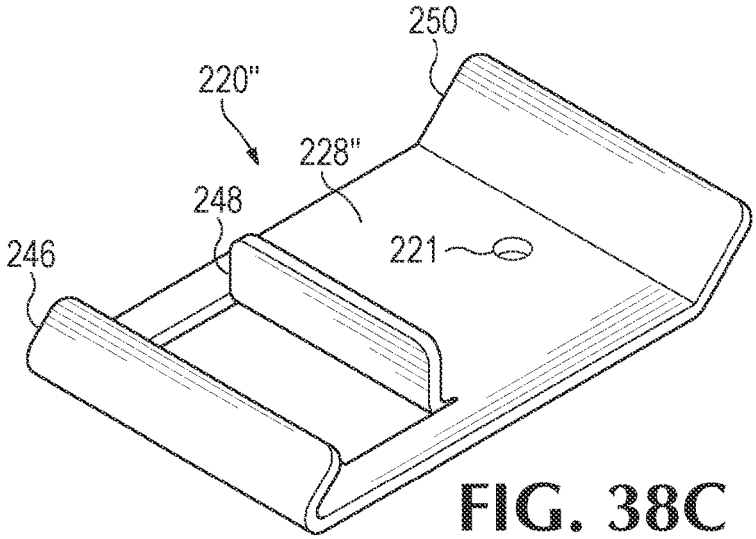
FIG. 38C is an isometric view of a hold-down device similar to, but of simpler construction, than the one shown in FIG. 38B.

As shown in FIGS. 36C and 37 a primary deck board securing clip 238 and a starter deck board securing clip 284 are similar to the primary clip 228 and starter clip 222 except for having two attachment members 230 and 276, respectively, spaced apart from one another and extending parallel with each other so as to fit against opposite vertical sides 21 of a joist 14 or similar member of a deck support structure. Each attachment member 230 or 276 may be provided with a hole 232 for receiving a fastener.

Instead of being of a size to fit atop a single joist 14 or the like, the starter clip 222 may instead be a starter rail, as shown foreshortened in FIG. 37, long enough to extend over the distance between two or more parallel joists 14, to locate and orient a first deck board 224 alongside which additional parallel deck boards 226, etc. are to be fastened to the deck supporting structure. With a deck board 224 secured to a joist the main portions of the primary clips 220 and the starter clip 276 or starter rail 222 elevate the deck board 224 slightly upward from the joist 14, providing some ventilation between all deck boards and the deck support structure.

As may be seen in FIGS. 38A, 38B, 38C, and 39, deck board hold-down devices or securing clips 220' and 220" may be provided with fastener receptacles such as through holes 221 in their main body or base plate portions 228', so that they may be nailed or screwed onto the top face 27 of a joist 14 or other support member of a deck support structure where required by certain circumstances, even though that may promote movement of moisture into the joist. The basic designs of such deck board hold-down devices, however, remain similar to those of the deck board hold-down devices 220 and 238. In the hold-down device 220' there is a downwardly extending side member 234 that may be aligned alongside the vertical face 21 of the joist 14, while in the hold-down device 220" there is no such side member.

Figure 39:
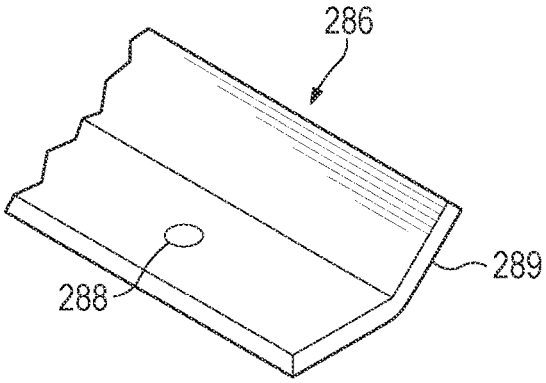
FIG. 39 is an isometric view of a portion of one of the hold-down devices shown in FIG. 38A.

A starter rail 286 shown in FIG. 39 may be of a desired length to lie along the top face of a structural member such as a header joist 287 to which the starter rail 286 may be fastened by a screw or nail extending down through a fastener hole 288. A fin 289 projects upwardly away from a base portion of the starter rail 286 at an angle that should be the same as the angle at which the third fin 250 of a hold-down clip 220' is oriented with respect to the main portion 228'.

Figure 40:
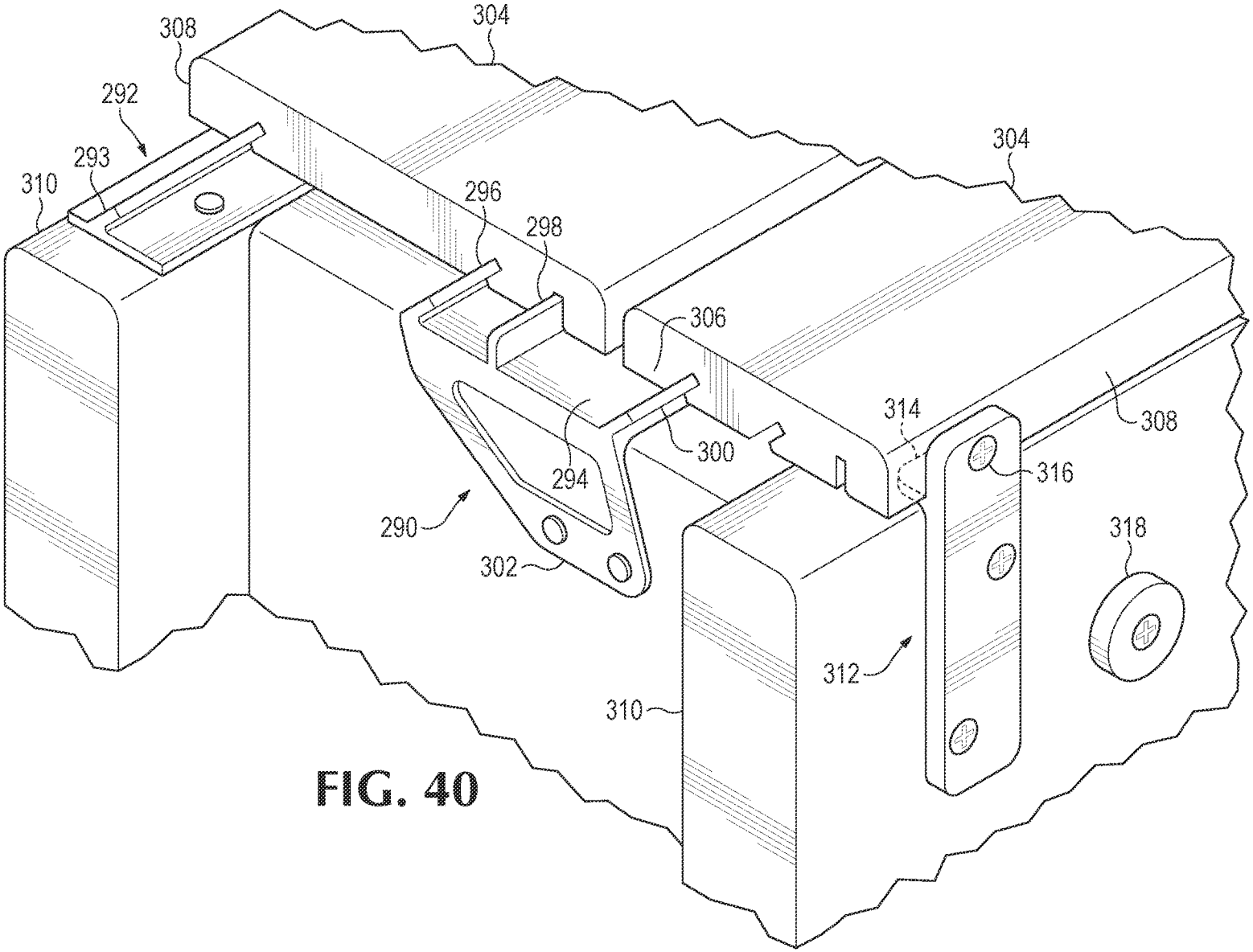
FIG. 40 is an isometric view of a portion of a deck support structure including a pair of parallel stringers and a transversely oriented joist extending between the stringers, with two deck boards resting atop the joist, and with hold-down devices engaged with slots defined in the bottom side of each deck board.
Figure 41:
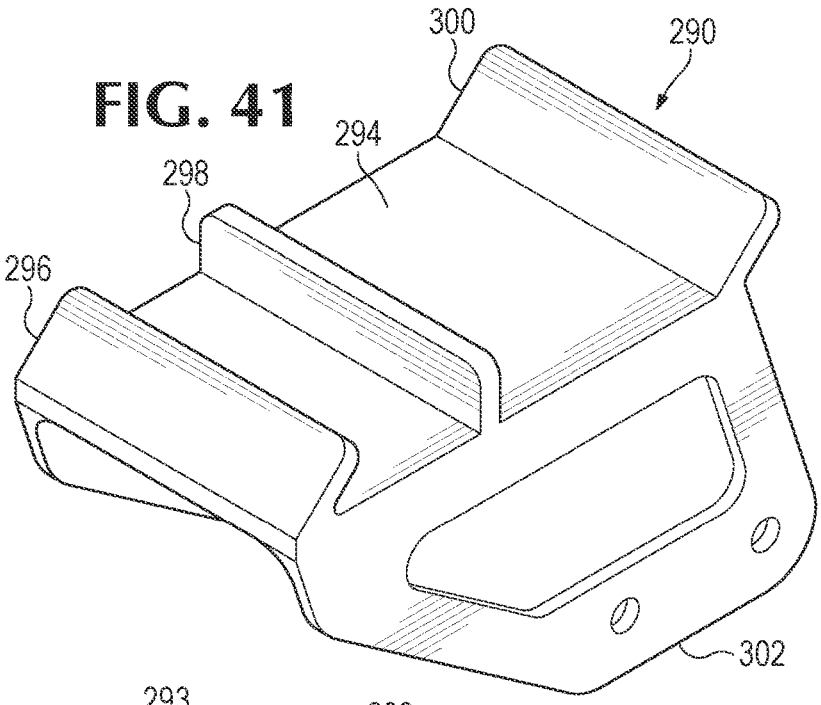
FIG. 41 is an isometric view of one of the hold-down devices shown in use in FIG. 40.
Figure 42:
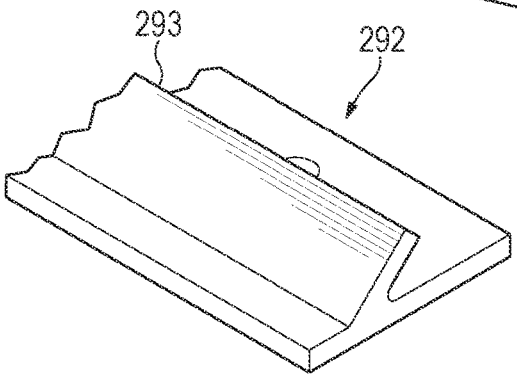
FIG. 42 is an isometric view of a portion of one of the hold-down devices shown mounted atop a stringer in FIG. 40.

Rather than being made of sheet metal, as shown in FIGS. 40-42, a deck board hold-down device or primary securing clip 290 and a starter clip or rail 292 may be of appropriate molded material such as fiber-reinforced PVC, polyethylene, polypropylene, aramid, or other composite material. In such a plastic or composite material version of the deck board primary securing clip 290 the base portion 294 and fins 296, 298, and 300 and the depending attachment member or members 302 may be integrally molded.

Figure 43:
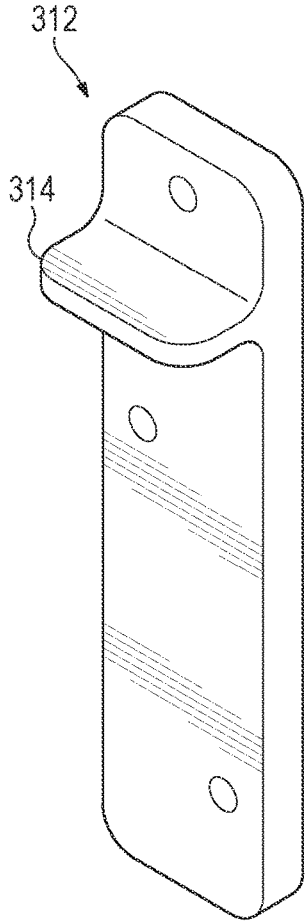
FIG. 43 is an isometric view of another one of the hold-down devices shown in FIG. 40.
Figure 44:
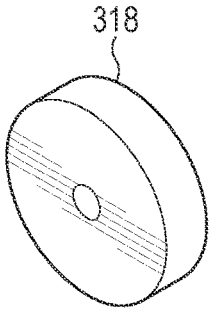
FIG. 44 is an isometric view of a spacer shown attached to one of the stringers in FIG. 40.

As may be seen in FIG. 40, a deck board 304 may have a portion 306 near one lateral side attached to the deck supporting structure by being mated with the third fin 300 of a deck securing clip 290, and the other, or outer, side 308 of the deck board 304 may be secured to an outer beam 310 or a ledger board by means of a finish clip 312. As shown in FIG. 43, the finish clip 312 includes a body shaped to be fastened to an upright, vertically-extending side of outer beam or support structure member 310, with a spacer arm 314 resting atop the structural member 30 and supporting the deck board 304 at a height equal to that of the main body portion 294 of the securing clip 290. An upper end of the finish clip 312 extends up alongside an outer lateral side face, or edge 308 of the final deck board 304, as shown in FIG. 40. A fastener hole extends through the upper portion of the finish clip 312, in position to accept a fastener such as a screw 316 or nail extending into the lateral edge face 308 of the deck board near the middle of its thickness so as to secure the deck board 304 to the supporting beam 310 without providing a path for water to move downward through the deck board. Spacers 318 may be provided as shown in FIGS. 40 and 44, in the form of discs of an appropriate thickness, to be attached to a deck support structural member 310 to preserve a uniform spacing between it and an adjacent structure such as a fascia board (not shown).

Figure 45:
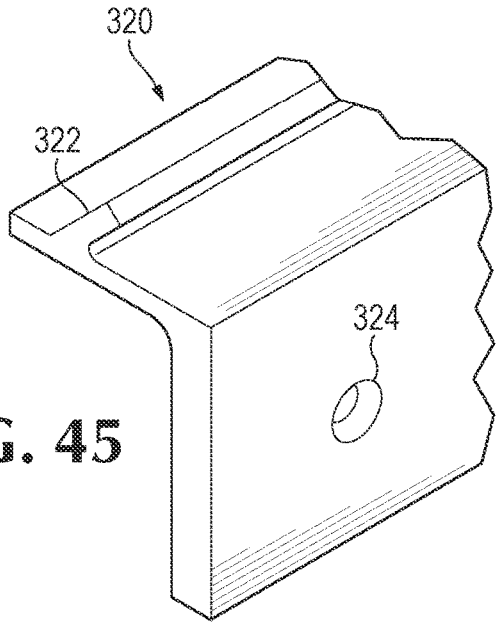
FIG. 45 is an isometric view of a portion of an elongate hold-down device adapted to be mounted to a side of a deck frame stringer or joist for securing a deck board.

A starter rail 320, shown in FIG. 45, includes a fin 322 inclined to fit into a third slot 258 in a deck board. The starter rail 320 is adapted to be mounted to a vertical side face of a supporting structural member by a screw or nail extending horizontally through a hole 324 to fasten a deck board 224 or 304 in place, as when building a deck by placing deck boards alongside one another beginning along a stringer or header to which the ends of joists are attached.

Attachment of Siding to a Building Wall

It is desirable to mount siding boards on an upright surface of a building wall so as to establish a ventilated space 325 between the siding boards and the surface of the building wall structure and to provide space for air to move between each siding board and an adjacent siding board above or below it. While this may be most important for wooden siding, composite siding boards are available and mounting systems shown and described herein are also appropriate for siding boards of various materials other than wood. As shown in FIGS. 46-54, siding boards 330, 332, and 334 are mounted on an exterior wall 337 using mounting clips 336 that support and securely attach the siding boards to the exterior wall structure 337. The mounting clips 336 include engagement members in the form of fins 338, 340, and 342 that provide support and locate siding boards, as they are arranged to be received in corresponding slots 344, 346, and 348 defined in a rear or inner, face 350 of each siding board. The fins 336, 340, and 342 correspond functionally to the fins 246, 248, and 250 of the deck board securing devices 220 and 238, and the slots defined in such siding boards 330, 332, and 334 correspond to the slots 254, 256, and 258 provided in deck boards 224, 226, and 304 that are held down by the devices described above and shown in FIGS. 36-45.

Figure 46:
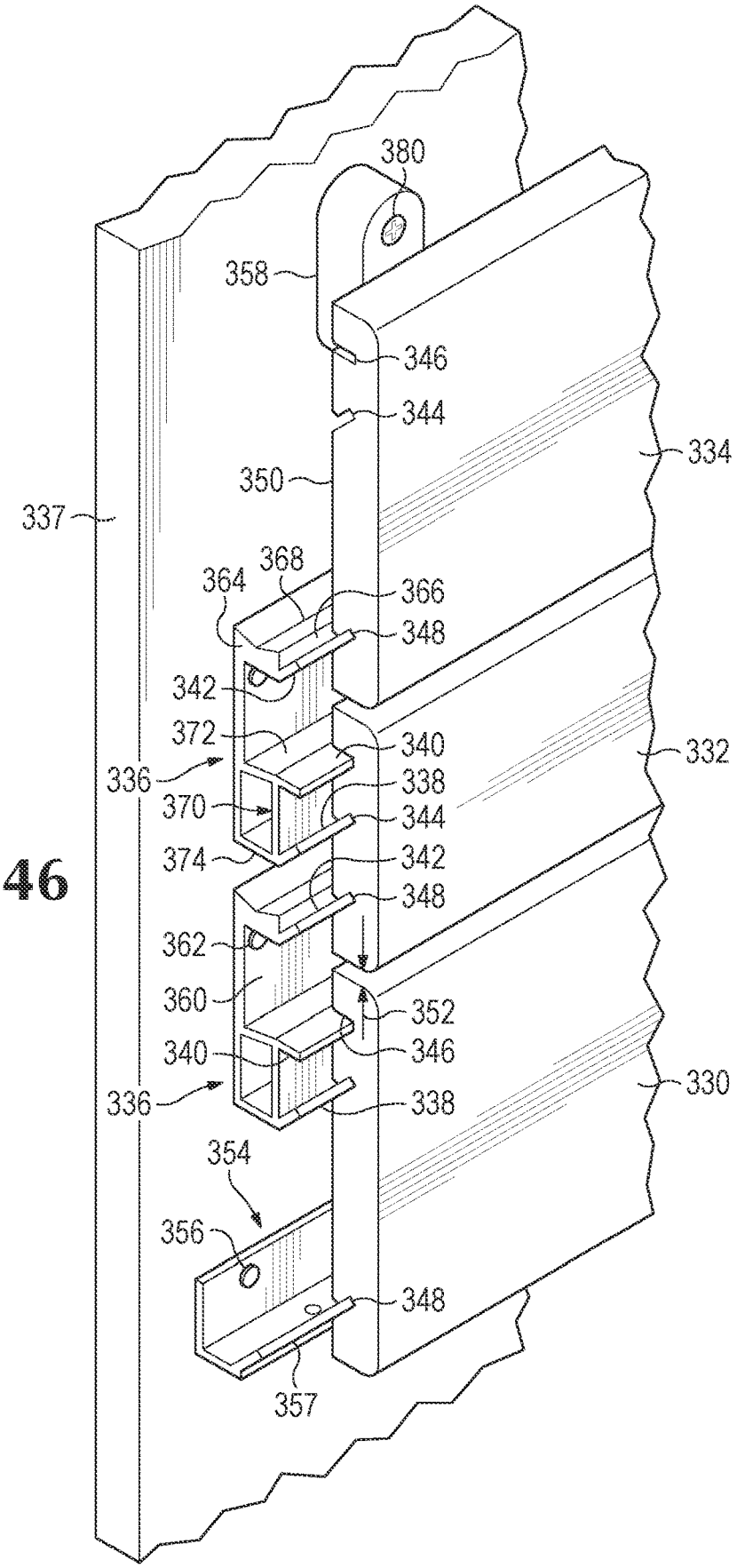
FIG. 46 is an isometric view of an area of an exterior wall structure of a building, showing use of a mounting system securely fastening siding boards to the wall structure while establishing and maintaining a space between exterior surfaces of the wall structure and the siding boards.
Figure 47:
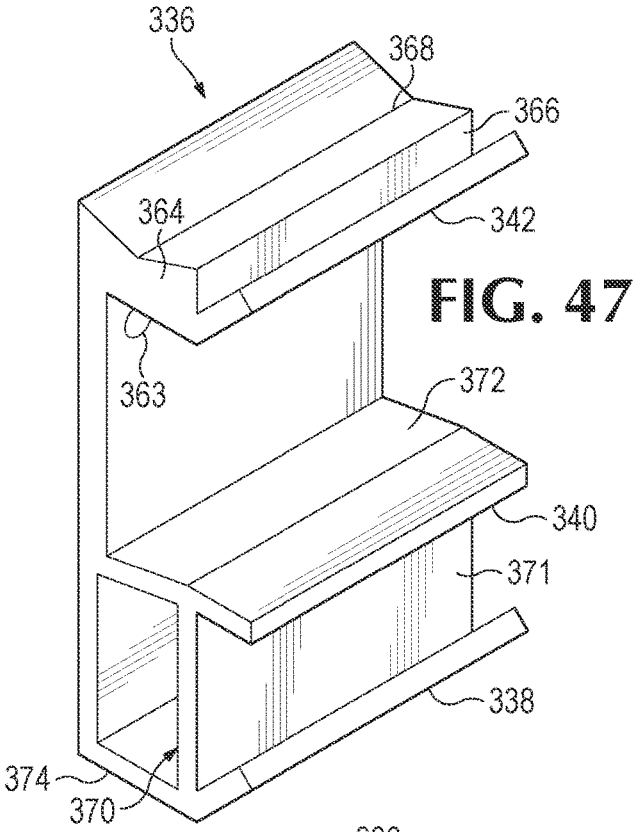
FIG. 47 is an isometric view of one of the siding board attachment devices included in the siding board mounting system depicted in FIG. 46.
Figure 49:
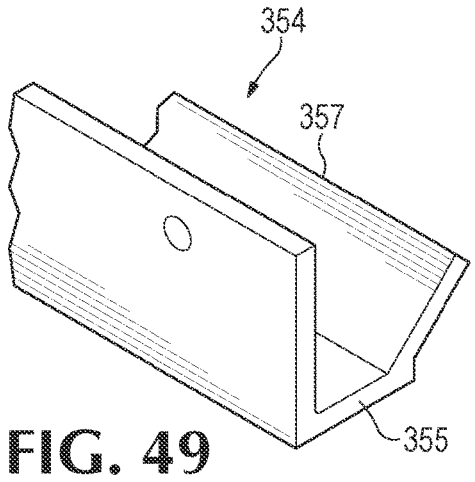
FIG. 49 is an isometric view of a starter rail that is part of the siding board mounting system shown in FIG. 46.
Figure 48:
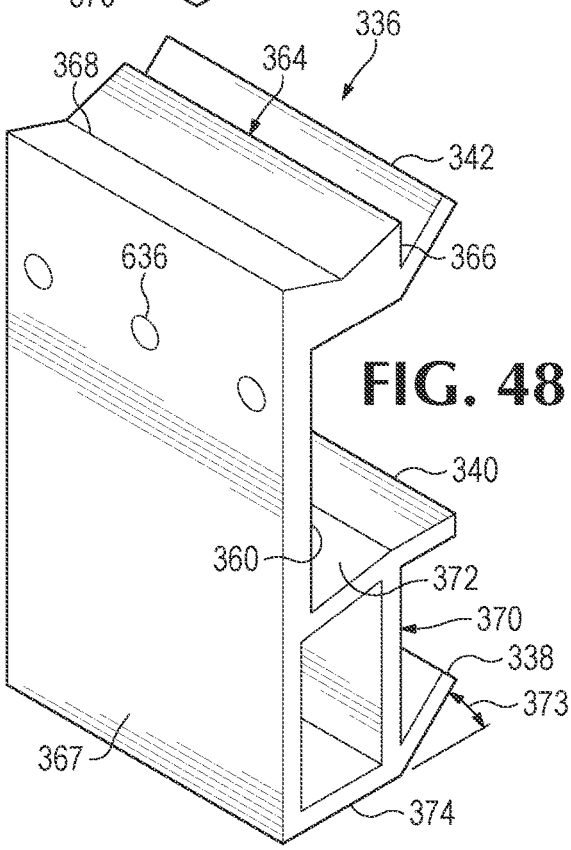
FIG. 48 is an isometric view of the siding board attachment device shown in FIG. 47, as seen from an opposite direction.
Figure 50:
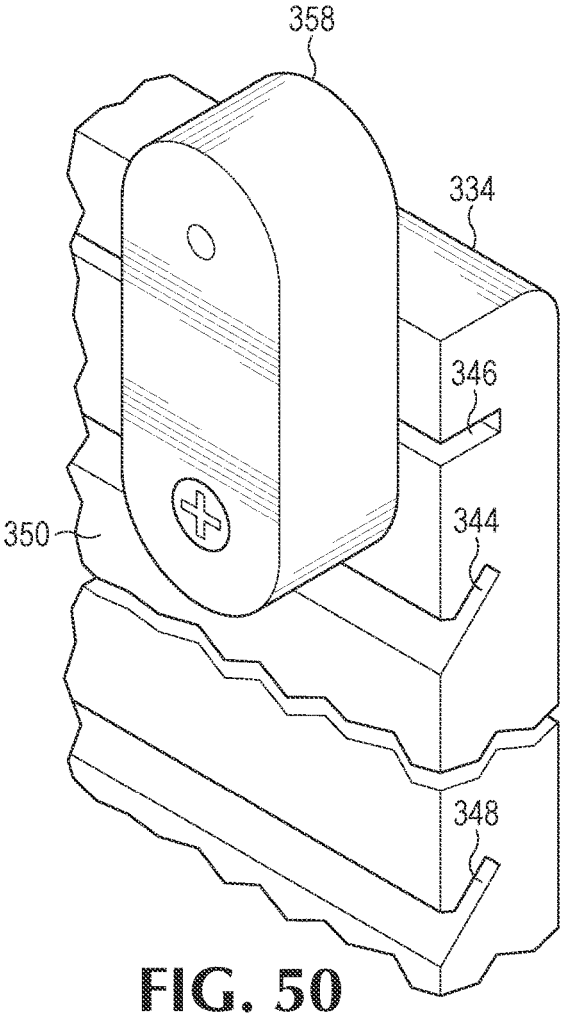
FIG. 50 is an isometric view of a finish spacer included in the siding board mounting system shown in FIG. 46, showing a manner of fastening the finish spacer to one of the siding boards.

The wall structure 337 of a building has a vertical generally planar surface on which the siding system is mounted. A starter rail 354 extends horizontally along a bottom margin of an area of the building wall to be covered by the siding system, as seen in FIG. 46, and may be held in place by fasteners such as nails or screws 356 that extend horizontally into the building wall structure 337. Primary siding clips 336 shown in FIGS. 46-48 may be attached by similar fasteners that extend generally horizontally into the exterior wall structure 337. The upper margins of siding boards 334 at the upper margin of the area on which siding is mounted may be attached securely using spacers 358. The starter rail 354 has a bottom member 355 that projects outward away from the wall structure 337 by a standoff distance, and a fin 357 that projects from the bottom member 335 to the same distance as the fins 338, 340 and 342 to fit into a slot 348 in a siding board 334.

The primary siding mounting clips 336 include a generally planar base portion 360 from which standoff structures extend forward, outwardly away from the building wall structure 337. The primary siding clips 336 are attached to the building wall structure by fasteners 362 such as screws or nails that extend through fastener holes in the base portion 360. The holes may be located below and close to an upper standoff member 364 that can shelter the fasteners 362 from rain or the like that may have been blown into the ventilation space between the siding boards 332 and 334 and an exterior building wall structure 337.

The upper standoff structure 364 extends outwardly or forward from the base portion 360 by a distance providing a desired separation, such as ¾ inch or 10 mm, between the inner side of each siding board 330, 332, or 324, and the surface of the building wall structure 337. The upper standoff structure includes an outer face 366, and an inner main face 350 of a siding board 332 or 334 can rest in contact against the outer face 366 of the upper standoff member. An upper, or third, supporting fin 342, corresponding functionally to the third fin 250 of the deck board securing device 220 or 238, extends horizontally along a lower edge of the outer face 366 of the upper standoff member 364 and is upwardly inclined at the same angle as a corresponding slot 348 defined in a lower portion of the inner main face 350 of a siding board 332 or 334. The angle at which the upper fin 342 is oriented may conveniently be the same as the angle at which the first, or lower supporting fin 338 extends upwardly away from the standoff tube 370. Having parallel first and third fins 338 and 342 may facilitate preparation of the slots 344 and 348 in the inner main face 350 of each siding board, the angles at which the respective supporting fins 342 and 338 extend away from the upper and lower standoff members are not critical, but the system requires them to be the same as for the slots in the siding boards. As with the deck board securing device 220, the locations of the slots 344, 346, and 348 in the siding boards 330 and 332 determine an open ventilating spacing 352 of a desired size between adjacent siding boards 330 and 332. This creates paths for movement of air to ventilate the space between the siding boards 330, 332, or 334 and the wall structure 337 supporting the siding clips 339, etc.

The upper standoff member 364 may have a pair of upper surfaces that cooperatively define a shallow trough 368 between the inner main face 350 of a supported siding board 332 or 334 and the exterior surface of the building wall structure 337. Since the upper standoff member 364 extends outwardly from the planar base portion 360 of the primary clip 336 it provides shelter for the heads of the fasteners 362 to reduce the likelihood that any rain that has penetrated between the siding boards will be led into the building wall structure 337 along the fasteners.

A lower standoff structure 370 may be in the form of a tube that extends forward, or outwardly away from the base portion 360 and extends laterally along the front or outer face of the base portion 360. In a siding clip providing a smaller standoff distance the lower standoff structure 370 may be solid rather than tubular. An upper face 372 of the standoff structure 370 may be inclined inwardly toward the base portion 360, forming a shallow trough along the front or outer face of the base portion 360. A lower member 374 of the tube, including a lower face of the lower standoff structure 370, may be horizontal. A front member of the tube may be upright, parallel with the base member portion of the primary siding clip, and may have an outer face 371 spaced apart from the base portion and located at the desired standoff distance from a rear, or mounting face 367, and thus a building wall structure 337 on which the primary clip 336 is mounted. Of the fins of the primary mounting clip 336, a bottom, or first, fin 338 extends along the horizontal lower front corner of the lower standoff structure 370 and projected at an upward and outward angle 373 that may preferably be in the range of 25°-55° above horizontal. A second fin 340 extends along the upper outer horizontal corner of the lower standoff structure 370 and may project outwardly horizontally, perpendicular to the plane of the base portion 360 of the mounting clip 336, so that the first and second fins 338 and 340 converge toward each other, and the first, or lowest, fin 338 can tend to hold the siding board 330 or 332 in toward the wall structure and provide vertical support, as well. The primary clips 336, then, must be engaged with siding boards by sliding the fins 338 and 340 along the slots 344 and 346. When the first and second fins 338 and 340 are engaged in the corresponding slots 344 and 346 in the upper part of a siding board 332 or 334 they provide vertical support for the siding board but also prevent the siding board from being moved outwardly away from the exterior surface exterior building structure, in a manner similar to the retention of a deck board by the convergent or divergent fins 246 and 248 of the deck board hold-down securing devices 220 and 238 described above and shown in FIGS. 36 through 41.

A spacer 378, which may be of a suitable plastic or composite material, has a thickness equal to the standoff distance established by the standoff structures 364 and 366 of the primary clips 336. The spacer 378 may be fastened to the rear or inner side 350 of the uppermost board 334 of an area of siding, extending above the siding board 334 far enough to receive a fastener 380 extending through the spacer 378 into the exterior wall structure 337 being protected by the siding system.

While the siding support members 326, 354, and 378 described above and illustrated in FIGS. 46-50 may be of a suitable molded metal, composite, or plastics material, equivalent standoff siding mounting clips 392 may be manufactured of sheet metal as shown in FIGS. 51-54.

A bottom support rail 384 may be of suitably thick sheet metal, such as 12-gauge sheet steel, bent to have a base portion 386 that includes holes for fasteners, to hold it against an exterior building wall structure 337, with a standoff member 387 extending generally perpendicularly away from the building wall structure when the support rail 384 is mounted. A supporting fin 388 extends along the rail and is outwardly and upwardly inclined at an angle in a range of, for example, 25°-55°, matching the angle of the upper or third fin of the primary siding clip 336 and a slot 348 defined in the back or inner side 350 of the lower portion of a siding board 330, as may be seen in FIG. 51. A primary siding mounting clip 392, seen completely exposed in FIGS. 52-53, may also be formed by bending sheet metal to define a planar main portion or base member 394 intended to rest snugly against a vertical building wall surface 337. An upper standoff portion 396 extends outward at a right angle from the main portion 394 and has an upper or third support locator fin 398 extending outwardly at an upwardly inclined orientation along an outer margin of the upper standoff portion 396.

A lower standoff portion 400 extends horizontally and is directed outwardly, away from the main portion 394 at a 90° angle. A depending member 402 may be a central strip of the sheet metal, cut free from portions of the planar main portion or base member 384 and the lower standoff portion 400, bent to extend downward from the lower standoff portion 400. The depending member 402 has an outer, or standoff, face 404 located at the desired standoff distance from a rear surface 403 of the main portion 394. A distal end of the depending member 402 of sheet metal is bent to extend outwardly at an upwardly inclined orientation as a lower, or first support and locator fin 406. The outwardly-directed lower standoff portion 400 extends outwardly beyond the lower standoff face 404 as a horizontal second support and locator fin 408.

As in the deck board securing devices 220 and 238 and the primary siding attachment standoff clip 336 mentioned above, the orientations of the first fin 406 and the third fin 398 may, but need not, be parallel, and need not be at any particular angular orientation with respect to the main portion 394 and the generally vertical exterior wall 337 structure to which the siding is to be attached, but the fins do need to be oriented at the same angles as the respective slots 344, 346 and 348 defined in the back or inner side 350 of the siding boards 330, 332, and 334, and the spacing between the upper two slots 344 and 346 has to match the spacing between the first and second fins 406 and 408.

Figure 51:
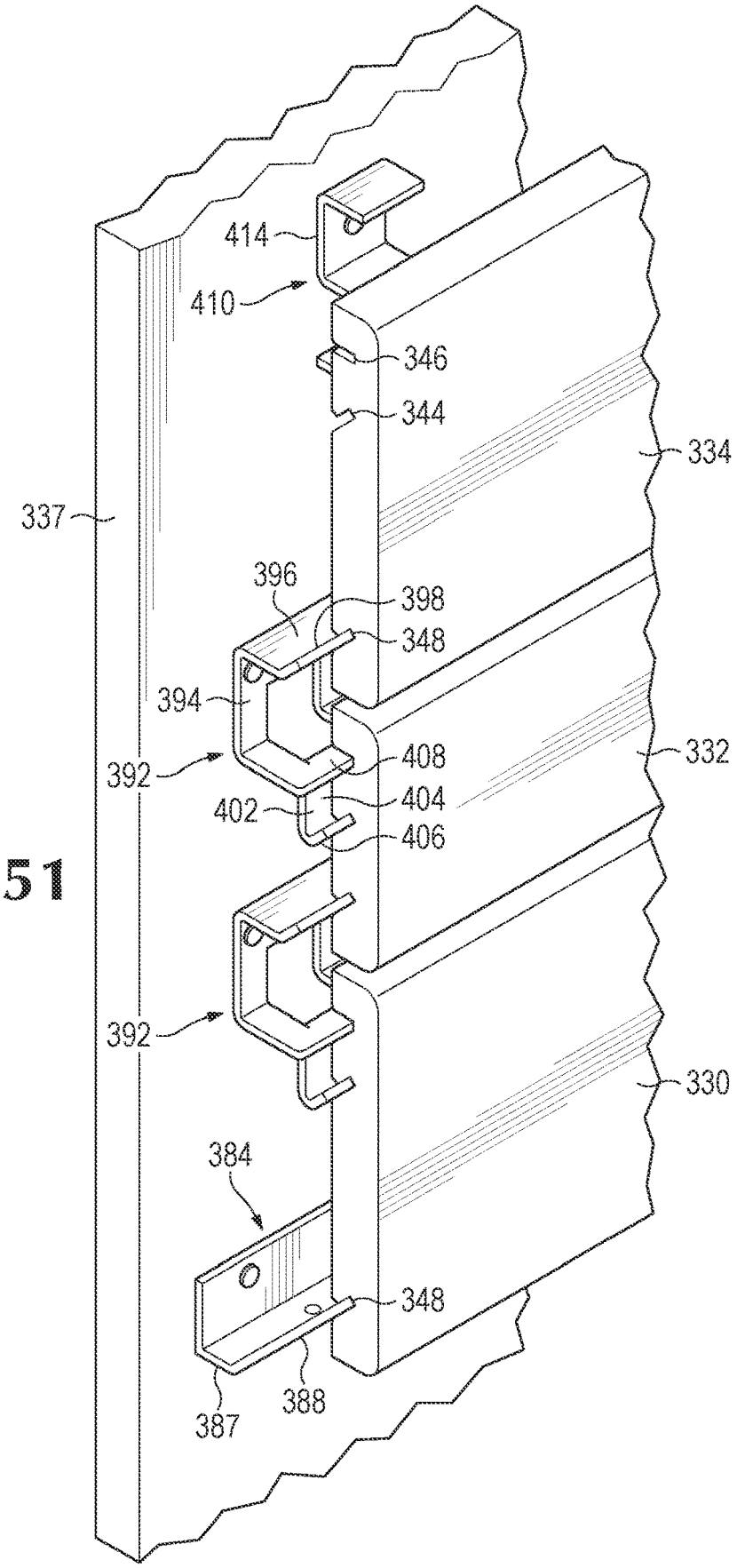
FIG. 51 is an isometric view of an area of an exterior wall structure of a building, showing use of a mounting system that is similar to the mounting system shown in FIGS. 46-50, securely attaching the siding boards to a building wall while establishing and maintaining a space between the exterior surfaces of the building wall structure and the siding boards.
Figure 52:
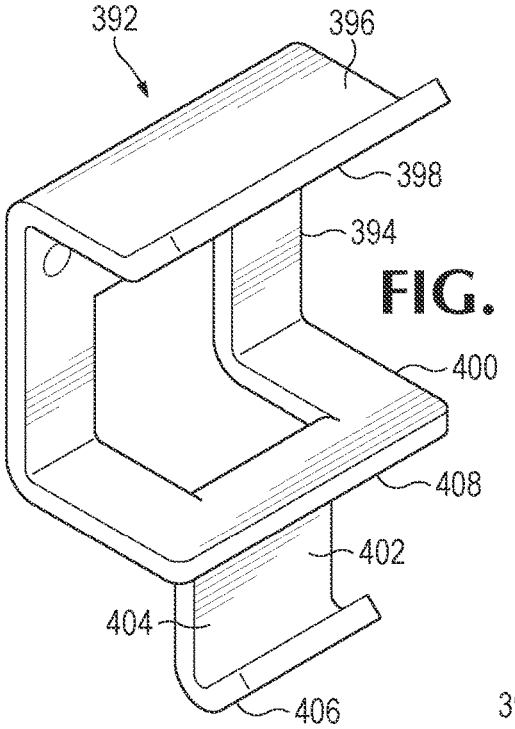
FIG. 52 is an isometric view of one of the siding board mounting devices included in the mounting system shown in FIG. 51.
Figure 53:
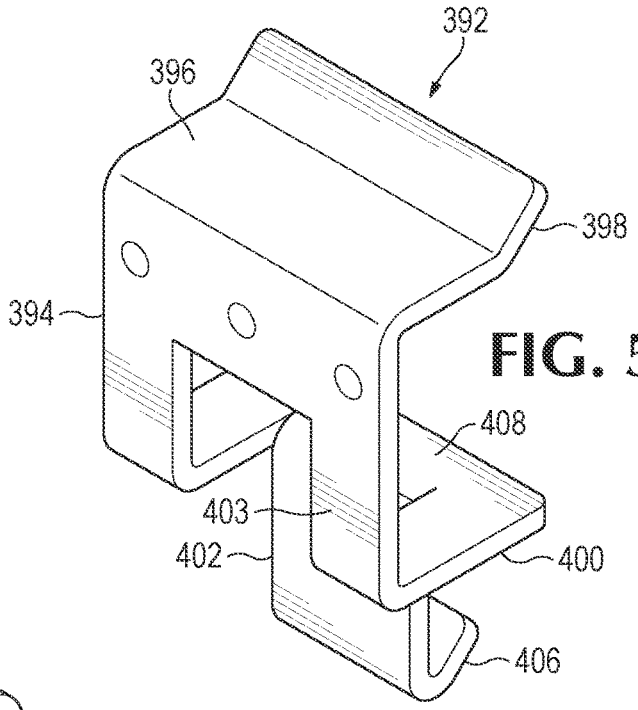
FIG. 53 is an isometric view of the mounting device shown in FIG. 52, as seen from an opposite direction.
Figure 54:
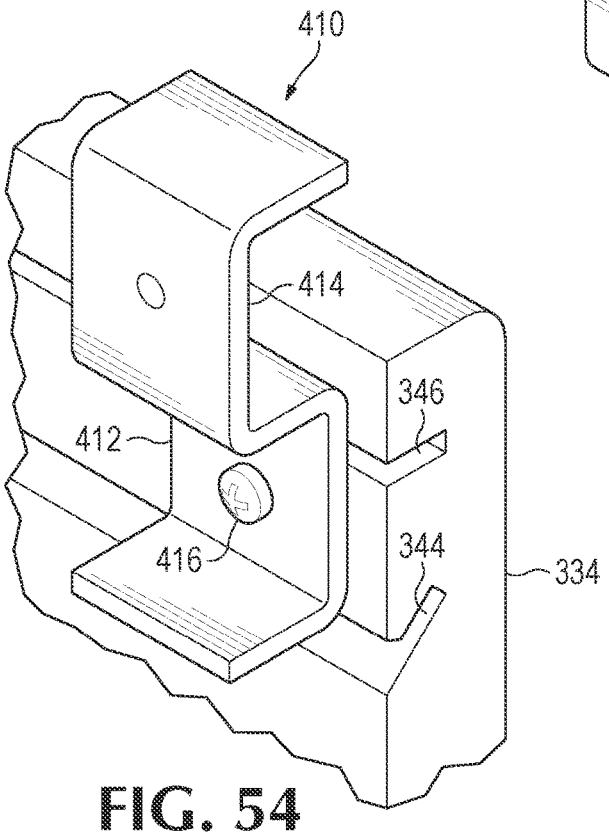
FIG. 54 is an isometric view of a spacer device that is part of the mounting system shown in FIG. 51, for use in attachment of an uppermost siding board to an exterior of a building wall structure.

As shown in FIGS. 51 and 54, instead of the molded plastic standoff member 358 for use on an uppermost siding board 334 of an area, there is a standoff mounting member 410 of sheet metal, which may be a generally "S" shaped piece with a pair of parallel vertical portions 412 and 414, each defining a hole for receiving a fastener. The standoff member can be attached to an upper portion of an uppermost siding board 334 with a suitable fastener such as a screw 416 too short to pass entirely through the siding board 334, and with an upper vertical portion 414 of the standoff fastener being attached by a fastener directed into the exterior wall structure, as shown in FIG. 51.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A deck board securing device, comprising:

(a) a base portion adapted to rest on a top face of a deck support member of a deck support structure, the base portion defining a base plane parallel with an intended orientation of a bottom face of a deck board;

(b) an attachment member extending from the base portion at an angle with respect to the base plane and configured to fit against a side face of the deck support member, the attachment member further:

(i) defining a fastening plane and configured to be attached to a support member of a deck support structure with the fastening plane parallel with a vertical surface of the deck support member;

(ii) a spacer neck extending away from the attachment member, the spacer neck having a length and having a spacing dimension extending in a direction parallel with the fastening plane, the spacing dimension defining a desired spacing between a pair of adjacent deck boards to be attached to the deck support structure by use of the hold-down device;

(iii) an engagement head attached to the spacer neck and spaced apart from the attachment member, the engagement head including a deck board-engaging portion extending in a plane oriented perpendicular to the fastening plane;

(c) a first deck board-engaging fin member having a root extending along the base portion, the first deck board-engaging fin member projecting away from the base portion at a first angle with respect to the base plane; and (d) a second deck board-engaging fin member having a root extending along the base portion parallel with and spaced a distance apart from the first deck board-engaging fin member, the second deck board-engaging fin member projecting away from the base portion at a second angle with respect to the base plane, the first angle and the second angle differing from each other by at least 20°.

2. The deck board securing device of claim 1, wherein the first angle and the second angle differ from each other by 30° to 60°.

3. The deck board securing device of claim 1 including a third deck board-engaging fin member having a root extending along the base portion parallel with and spaced apart from the first deck board-engaging fin member by a predetermined distance, the third deck board-engaging fin member being inclined and projecting upwardly and away from the first and second deck board-engaging fin members and projecting away from the base portion at an obtuse angle with respect to the base plane.

4. The deck board securing device of claim 1 wherein one of the first and second deck board-engaging fin members of the deck board securing device is oriented perpendicular to an upper surface of the base portion.

5. A deck system, comprising:

(a) a support member having a side face and having a top face oriented parallel with a desired orientation of a top face of a deck board;

(b) a deck board securing device, comprising;

(i) a base portion adapted to rest on the top face of the deck support member, the base portion defining a base plane parallel with an intended orientation of a bottom face of a deck portion board;

(ii) an attachment member extending from the base portion at an angle with respect to the base plane and configured to fit against the side face of the support member, where the attachment member defines a fastening plane and configured to be attached to a support member of a deck support structure with the fastening plane parallel with a vertical surface of the support member;

(iii) a spacer neck extending away from the attachment member, the spacer neck having a length and having a spacing dimension extending in a direction parallel with the fastening plane, the spacing dimension defining a desired spacing between a pair of adjacent deck boards to be attached to the deck support structure by use of the hold-down device;

(iv) an engagement head attached to the spacer neck and spaced apart from the attachment member, the engagement head including a deck board-engaging portion extending in a plane oriented perpendicular to the fastening plane;

(v) a first deck board-engaging fin member having a root extending along the base portion and projecting away from the base portion at a first angle with respect to the base plane;

(vi) a second deck board-engaging fin member having a root extending along the base portion parallel with and space a distance apart from the first deck board-engaging fin member projecting away from the base portion at a second angle with respect to the base plane, the first angle and the second angle differing from each other by at least 20°; and (vii) a third deck board-engaging fin member having a root extending along the base portion parallel with an spaced apart from the first deck board-engaging member by a predetermined distance, the third deck board-engaging member being inclined and projecting upwardly and away from the first and second deck board-engaging fin members and projecting away from the base portion at an obtuse angle with respect to the base plane; and (c) a deck board attached to the support member by the deck board securing device, the deck board having a length and a bottom face, and the deck board defining first and second slots extending lengthwise along the deck board and extending a distance into the deck board from the bottom face, the first and second slots being spaced apart from each other and oriented at respective angles with respect to the bottom face corresponding respectively with the orientation of and the distance between the first and second deck board-engaging fin members of the deck board securing device, and (d) the first and second deck board-engaging fin members of the deck board securing device extending respectively into the first and second slots, and the bottom face thereby being held in contact with the base portion of the deck board securing device and parallel with the top face of the support member.

6. The deck system of claim 5 wherein the deck board securing device includes a pair of the attachment members oriented parallel with each other and spaced apart from each other by a predetermined distance related to a width of the support member.

7. The deck system of claim 6 wherein the ones of the pair of attachment members are offset from each other in a direction parallel with a length of the support member and wherein the base portion of the deck board securing device extends diagonally across and along the top face of the support member.

* * * * *